US007536982B2

(12) United States Patent
Yuasa et al.

(10) Patent No.: US 7,536,982 B2
(45) **Date of Patent: *May 26, 2009**

(54) TWO-CYCLE COMBUSTION ENGINE OF AIR SCAVENGING TYPE

(75) Inventors: Tsuneyoshi Yuasa, Kobe (JP); Yoshiro Yamane, Akashi (JP); Masanori Kobayashi, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 748 days.

This patent is subject to a terminal disclaimer.

(21) Appl. No.: 10/530,153

(22) PCT Filed: Oct. 10, 2003

(86) PCT No.: PCT/JP03/12682

§ 371 (c)(1),
(2), (4) Date: Apr. 1, 2005

(87) PCT Pub. No.: WO2004/038195

PCT Pub. Date: May 6, 2004

(65) Prior Publication Data

US 2005/0284430 A1 Dec. 29, 2005

(30) Foreign Application Priority Data

Oct. 11, 2002 (JP) ..... 2002-299286
Feb. 27, 2003 (JP) ..... 2003-050905

(51) Int. Cl.
*F02B 33/04* (2006.01)
*F02B 25/00* (2006.01)

(52) U.S. Cl. ..... 123/73 PP; 123/73 A

(58) Field of Classification Search ..... 123/73 PP, 123/73 A, 73 S, 65 A, 73 DA, 74 AA, 73 AD
See application file for complete search history.

(56) References Cited

U.S. PATENT DOCUMENTS 3,753,425 A 8/1973 Hooper
4,109,622 A * 8/1978 Fujikawa et al. ..... 123/73 A
4,328,769 A * 5/1982 Fujikawa et al. ..... 123/41.47
4,414,929 A 11/1983 Sakurai
4,831,979 A 5/1989 DuBois et al.
5,052,355 A 10/1991 Ito et al.
5,490,483 A 2/1996 Tanikake et al.

(Continued)

FOREIGN PATENT DOCUMENTS

DE 873 459 4/1953

(Continued)

*Primary Examiner*—Stephen K Cronin
*Assistant Examiner*—Sizo B Vilakazi

(57) ABSTRACT

An engine including first scavenging passages for fluidly connecting between a combustion chamber and a crank chamber through bearings for the crankshaft, second scavenging passages fluidly connecting directly between the combustion chamber and the crank chamber, a suction chamber formed in a side face of a piston. An air-fuel mixture is sucked into the suction chamber and an air is introduced into the crank chamber. During the intake stroke, the air-fuel mixture from the air-fuel mixture passage is introduced into the first scavenging passages through the suction chambers, and the air is introduced into the crank chamber. During the scavenging stroke, before the air-fuel mixture in the first scavenging passages is introduced into the combustion chamber, introduction of the air in the crank chamber into the combustion chamber through the second scavenging passages starts.

17 Claims, 29 Drawing Sheets

U.S. PATENT DOCUMENTS

| | | | | |
|---|---|---|---|---|
| 6,135,072 | A * | 10/2000 | Kishita | 123/73 A |
| 6,257,179 | B1 | 7/2001 | Uenoyama et al. | |
| 6,279,521 | B1 | 8/2001 | Ishida et al. | |
| 6,289,856 | B1 | 9/2001 | Noguchi | |
| 6,352,058 | B1 | 3/2002 | Yuasa et al. | |
| 6,367,432 | B1 | 4/2002 | Araki | |
| 6,418,891 | B2 | 7/2002 | Kobayashi | |
| 6,497,204 | B1 * | 12/2002 | Miyazaki et al. | 123/73 PP |
| 6,662,766 | B2 * | 12/2003 | Araki et al. | 123/73 PP |
| 6,901,892 | B2 * | 6/2005 | Mavinahally et al. | 123/73 V |
| 6,978,744 | B2 * | 12/2005 | Yuasa et al. | 123/73 PP |
| 2002/0002958 | A1 | 1/2002 | Uchida et al. | |
| 2002/0020370 | A1 | 2/2002 | Araki | |
| 2002/0139326 | A1 | 10/2002 | Araki | |
| 2003/0075123 | A1 | 4/2003 | Araki et al. | |
| 2003/0140874 | A1 * | 7/2003 | Zama et al. | 123/65 P |

FOREIGN PATENT DOCUMENTS

| | | |
|---|---|---|
| DE | 1 144 056 | 2/1963 |
| JP | 56012008 | 2/1981 |
| JP | 56-97506 | 8/1981 |
| JP | 58-005424 | 1/1983 |
| JP | 60-173314 | 9/1985 |
| JP | 2-124205 | 10/1990 |
| JP | 03-160105 | 7/1991 |
| JP | 3-82864 | 8/1991 |
| JP | 4-65910 | 6/1992 |
| JP | 05-256138 | 10/1993 |
| JP | 07-035126 | 2/1995 |
| JP | 08-061068 | 3/1996 |
| JP | 10-002207 | 1/1998 |
| JP | 10-212945 | 8/1998 |
| JP | 11-030153 | 2/1999 |
| JP | 2000-179346 | 6/2000 |
| JP | 2000-320338 | 11/2000 |
| JP | 2001-173447 | 6/2001 |
| JP | 2001-193557 | 7/2001 |
| JP | 2001-295654 | 10/2001 |
| JP | 2001-349222 | 12/2001 |
| JP | 2002-054443 | 2/2002 |
| JP | 2002-129963 | 5/2002 |
| JP | 2002-195073 | 7/2002 |
| WO | 98/57053 | 12/1998 |

* cited by examiner

TWO-CYCLE COMBUSTION ENGINE OF AIR SCAVENGING TYPE

FIELD OF THE INVENTION

The present invention relates mainly to a two-cycle internal combustion engine of an air scavenging type that is used as a drive source for a compact rotary machine such as, for example, a brush cutter.

BACKGROUND ART

The conventional combustion engine of this kind is known to be so designed that, prior to scavenging of a combustion chamber with an air-fuel mixture, the combustion chamber is initially scavenged with an air to suppress the blow-off of the air-fuel mixture through an exhaust port. (See, for example, the Japanese Laid-open Patent Publication Nos. 2001-173447 and 58-5424.)

It has been found that while in the two-cycle combustion engine of this air scavenging type, bearings disposed in the engine cylinder block for the support of the crankshaft are lubricated with the air-fuel mixture introduced into the crank chamber, an attempt to make the combustion engine of this kind compact tends to reduce the size of a gap through which the air-fuel mixture within the crank chamber to such an extent as to make it difficult to lubricate the bearings. For this reason, formation of oil supply passages to lubricate the bearings effectively renders the engine structure complicated.

DISCLOSURE OF THE INVENTION

In view of the foregoing, the present invention has for its object to provide a two-cycle combustion engine in which a fluid circuit through which an air-fuel mixture can flow by way of bearings so that the bearings can be sufficiently lubricated with a simplified structure.

In order to accomplish the foregoing object, the two-cycle combustion engine according to a first aspect of the present invention includes a first scavenging passage for communicating between a combustion chamber and a crank chamber through a bearing for a crankshaft, a second scavenging passage for communicating directly between the combustion chamber and the crank chamber, a suction chamber formed in a side face of a piston, an air-fuel mixture passage for introducing an air-fuel mixture M into the suction chamber, and an air passage for introducing an air into the crank chamber, and is so designed that during an intake stroke of the engine, the air-fuel mixture from the air-fuel mixture passage can be introduced into the first scavenging passage through the suction chamber and the air from the air passage is introduced into the crank chamber, and that during a scavenging stroke of the engine, introduction of the air within the crank chamber into the combustion chamber through the second scavenging passage can take place before the air-fuel mixture within the first scavenging passage is introduced into the combustion chamber.

With this two-cycle combustion engine, when the air-fuel mixture is introduced from the first scavenging passage into the crank chamber during the intake stroke, or when the air-fuel mixture within the crank chamber is introduced from the first scavenging passage into the combustion chamber during the scavenging stroke, such air-fuel mixture flows through the bearing for the crankshaft. In other words, the path of flow of the air-fuel mixture through the bearing is established. Accordingly, the bearing for the crankshaft can be satisfactorily lubricated with a simple structure, by a fuel contained in the air-fuel mixture. Also, during the scavenging stroke, prior to the air-fuel mixture within the first scavenging passage being introduced into the combustion chamber, the air introduced into the crank chamber during the intake stroke can be introduced into the combustion chamber through the second scavenging passage. In other words, initial scavenging takes place with the air first introduced into the combustion chamber, followed by the scavenging with the air-fuel mixture and, therefore, the blow-off of the air-fuel mixture can be satisfactorily suppressed.

The two-cycle combustion engine according to a second aspect of the present invention includes a first scavenging passage for communicating directly between a combustion chamber and a crank chamber, a second scavenging passage for communicating between the combustion chamber and the crank chamber through a bearing for a crankshaft, a suction chamber formed in a side face of a piston, an air passage for introducing an air into the suction chamber, and an air-fuel mixture passage for introducing an air-fuel mixture into the crank chamber, and is so designed that during an intake stroke of the engine, the air from the air passage is introduced into the second scavenging passage through the suction chamber and the air-fuel mixture from the air-fuel mixture passage is introduced into the crank chamber, and that during a scavenging stroke of the engine, introduction of the air within the second scavenging passage into the combustion chamber takes place before the air-fuel mixture within the crank chamber is introduced into the combustion chamber through the first scavenging passage.

This two-cycle combustion engine may be considered having a path of flow of the air-fuel mixture and the air, which is substantially reverse to that in the two-cycle combustion engine according to the first aspect of the present invention. More specifically, it is featured in that during the intake stroke the air-fuel mixture is introduced directly from the air-fuel mixture passage into the crank chamber and the air is introduced into the second scavenging passage from the air passage. With this two-cycle combustion engine, since during the scavenging stroke this air-fuel mixture within the crank chamber flows through the bearing for the crankshaft when a portion of the air-fuel mixture within the crank chamber enters the second scavenging passage, the bearing for the crankshaft can be sufficiently lubricated with a simple structure. Also, since during the scavenging stroke the air introduced into the second scavenging passage during the intake stroke is introduced into the combustion chamber prior to the air-fuel mixture being introduced from the first scavenging passage into the combustion chamber, the blow-off of the air-fuel mixture can be satisfactorily suppressed by the air first introduced into the combustion chamber.

The two-cycle combustion engine according to a third aspect of the present invention includes a first scavenging passage for communicating directly between a combustion chamber and a crank chamber, a second scavenging passage for communicating between the combustion chamber and the crank chamber through a bearing for a crankshaft, an air passage for introducing an air into the second scavenging passage, a reed valve disposed in the air passage, and an air-fuel mixture passage for introducing an air-fuel mixture into the crank chamber, and is so designed that during an intake stroke of the engine, the air from the air passage is introduced into the second scavenging passage through the reed valve and the air-fuel mixture from the air-fuel mixture passage is introduced into the crank chamber, and that during a scavenging stroke of the engine, introduction of the air within the second scavenging passage into the combustion chamber takes place before the air-fuel mixture within the crank chamber is introduced into the combustion chamber through the first scavenging passage.

This two-cycle combustion engine is featured in that in place of the suction chamber defined in the side face of the piston according to the second aspect of the present invention, the reed valve is employed in the air passage, and except for this difference, other basic structural features thereof remain the same. With this two-cycle combustion engine, since when a portion of the air-fuel mixture introduced into the crank chamber enters the second scavenging passage during the scavenging stroke, this air-fuel mixture flows through the bearing for the crankshaft, the bearing for the crankshaft can be satisfactorily lubricated with a simple structure. Also, since during the scavenging stroke the air introduced into the second scavenging passage during the intake stroke is introduced into the combustion chamber prior to the air-fuel mixture being introduced from the first scavenging passage into the combustion chamber, the blow-off of the air-fuel mixture can be satisfactorily suppressed by the air so introduced first into the combustion chamber. Also, the reed valve is opened during the intake stroke to allow the air to be introduced from the air passage into the second scavenging passage. In other words, while in the two-cycle combustion engine according to the second aspect of the present invention, no air can be introduced into the second scavenging passage when during the intake stroke the cylinder block closes the suction chamber in the piston, the two-cycle combustion engine according to this third aspect of the present invention is such that the air is introduced at all times during a period in which the reed valve is opened in the intake stroke during which a negative pressure is developed inside the crank chamber, a sufficient amount of the air can be secured within the second scavenging passage.

In the two-cycle combustion engine according to a preferred embodiment of the present invention, the two-cycle combustion engine according to the first aspect thereof is additionally provided with a third scavenging passage, which is positioned at a location closer to an exhaust port opening to the combustion chamber for discharging an exhaust gas from the combustion chamber than the second scavenging passage, and is featured in that during the scavenging stroke, introduction of the air within the crank chamber into the combustion chamber through the second scavenging passage takes place before an air-fuel mixture introducing timing, at which the air-fuel mixture within the first scavenging passage is introduced into the combustion chamber, and that simultaneously with the air-fuel mixture introducing timing or at a timing thereafter, introduction of the air within the crank chamber into the combustion chamber through the third scavenging passage takes place, and except for those differences, other basic structural features thereof remain the same. With this two-cycle combustion engine, as is the case with the two-combustion engine according to the first aspect of the present invention, the bearing for the crankshaft can be lubricated with a simple structure while the blow-off of the air-fuel mixture is suppressed. Also, since introduction of the air within the crank chamber into the combustion chamber through the second scavenging passage takes place before the air-fuel mixture introducing timing, at which the air-fuel mixture within the first scavenging passage is introduced into the combustion chamber, and, simultaneously with the air-fuel mixture introducing timing or at the timing thereafter, the air within the crank chamber is introduced into a region of the combustion chamber adjacent the exhaust port, the blow-off of the air-fuel mixture can be more satisfactorily suppressed.

In another preferred embodiment of the present invention, in the two-cycle combustion engine according to the first aspect of the present invention, the piston has a lubricant passage formed therein for supplying the air-fuel mixture within the suction chamber to a small end bearing disposed between a piston pin and a connecting rod. According to this structural feature, the small end bearing is lubricated by the utilization of the air-fuel mixture introduced into the suction chamber.

The two-cycle combustion chamber according to a still further preferred embodiment of the present invention is featured in that in the two-cycle combustion engine according to the second aspect of the present invention, an air regulating valve is provided for closing the air passage when a pressure inside the air passage decreases to a value equal to or lower than a predetermined value, and except for this difference, other basic structural features thereof remain the same. Even in the case of this two-cycle combustion engine, as is the case with the two-cycle combustion engine according to the second aspect of the present invention, the bearing for the crankshaft can be lubricated with a simple structure while the blow-off of the air-fuel mixture is suppressed. Also, during a high boosting such as, for example, an idling, that is, when the pressure inside the air passage decreases to the value equal to or lower than the predetermined value, the air passage is closed by the air regulating valve and, therefore, introduction of the air into the crank chamber is interrupted. For this reason, dilution of the air-fuel mixture being introduced from the crank chamber to the combustion chamber during the idling can be avoided to thereby stabilize the rotation of the two-cycle combustion engine.

In a still further preferred embodiment of the present invention, in the two-cycle combustion engine according to the second or third aspect of the present invention, an opening of the first scavenging passage towards the crank chamber is closed by the piston before the piston reaches a bottom dead center. According to this feature, since when the piston nears the bottom dead center, the first scavenging passage is closed, introduction of the air-fuel mixture within the crank chamber into the combustion chamber at the end of the scavenging stroke can be prevented. For this reason, the blow-off of the air-fuel mixture can be more satisfactorily suppressed.

In a still further preferred embodiment of the present invention, in the preferred embodiment in which the second and third scavenging passages are employed, an opening of the second scavenging passage towards the crank chamber is closed by the piston before the piston reaches a bottom dead center. According to this feature, since the internal pressure inside the crank chamber increases as the piston approaches the bottom dead center, closure of the second scavenging passage with the piston at a location in the vicinity of the bottom dead center is effective to increase the force of blow-off of the air from the third scavenging passage which opens at a location adjacent the exhaust port. For this reason, the blow-off of the air-fuel mixture can be more satisfactorily suppressed.

In a still further preferred embodiment of the present invention, the second scavenging passage is positioned at a location closer to an exhaust port than the first scavenging passage in a direction circumferentially of the combustion chamber. According to this feature, since the air from the second scavenging passage can be supplied to a region in the combustion chamber adjacent the exhaust port, the blow-off of the air-fuel mixture from this exhaust port can be more satisfactorily suppressed.

The two-cycle combustion engine according to a fourth aspect of the present invention includes a first scavenging passage for communicating directly between a combustion chamber and a crank chamber, a second scavenging passage for communicating between the combustion chamber and the crank chamber through a bearing for a crankshaft, an air-fuel mixture passage for introducing an air-fuel mixture into the first scavenging passage, an air passage for introducing an air into the second scavenging passage, a first reed valve disposed in the air-fuel mixture passage, and a second reed valve disposed in the air passage, and is so designed in that during an intake stroke of the engine, the air-fuel mixture from the air-fuel mixture passage is introduced into the first scavenging passage and the air from the air passage is introduced into the second scavenging passage, and that during a scavenging stroke of the engine, introduction of the air within the second scavenging passage into the combustion chamber takes place before the air-fuel mixture within the first scavenging passage is introduced into the combustion chamber.

This two-cycle combustion engine is featured in that in the two-cycle combustion engine according to the third aspect of the present invention having the reed valve in the air passage, the first reed valve is employed in the air-fuel mixture passage, and except for this difference, other basic structural features thereof remain the same. With this two-cycle combustion engine, during the intake stroke the air-fuel mixture from the air-fuel mixture passage can be once introduced into the first scavenging passage through the first reed valve and the air from the air passage can be once introduced into the second scavenging passage through the second reed valve. Accordingly, only principally necessary amounts of the air-fuel mixture and the air can be allowed to fill up the first and second scavenging passages, respectively. For this reason, it is possible to prevent, an excessively enriched air-fuel mixture from entering the combustion chamber at the end of the scavenging stroke and then blowing off through the exhaust port. Also, a portion of the air-fuel mixture introduced into the first scavenging passage enters the crank chamber and lubricates the bearing for the crankshaft when entering the second scavenging passage during the scavenging stroke. In addition, since the air-fuel mixture behaves in such a manner that the enriched air-fuel mixture within the first scavenging passage enters the combustion chamber and, thereafter, the air-fuel mixture within the crank chamber, which is a leaned air-fuel mixture, enters the combustion chamber through the first scavenging passage, the blow-off of the enriched air-fuel mixture can be avoided with the charging efficiency increased consequently.

The two-cycle combustion engine according to a fifth aspect of the present invention includes a needle bearing for supporting a crankshaft within a crankcase, first and second scavenging passages for communicating between a combustion chamber and a crank chamber, an air-fuel mixture passage for introducing an air-fuel mixture into the crank chamber or the first scavenging passage during an intake stroke, an air passage for introducing an air into the second scavenging passage or the crank chamber during the intake stroke, and a communicating hole for fluidly connecting the first or second scavenging passage with the needle bearing, and is so designed that during a scavenging stroke, introduction of the air within the second scavenging passage into the combustion chamber takes place prior to the air-fuel mixture within the first scavenging passage being introduced into the combustion chamber, and that an opening of a lower end of the second scavenging passage towards the crank chamber is positioned at a location adjacent a region radially outwardly of the needle bearing.

According to the fifth aspect of the present invention, during the scavenging stroke the air-fuel mixture within the crank chamber flows into the needle bearing from the first or second scavenging passage through the communicating hole to thereby lubricate the needle bearing. Also, since as compared with ball bearings generally used to support the crankshaft, the needle bearing has a small outer diameter, extension of the second scavenging passage downwardly straight a distance corresponding to the difference in outer diameter is effective to increase the capacity so that a sufficient amount of the air can be secured in the second scavenging passage. Accordingly, during the scavenging stroke, the sufficient amount of the air can be injected from the second scavenging passage into the combustion chamber. Moreover, since the second scavenging passage can be formed to extend straight having an increased length, an undesirable increase of the flow resistance therein can be suppressed.

DETAILED DESCRIPTION OF THE EMBODIMENTS

Hereinafter, preferred embodiments of the present invention will be described in detail with particular reference to the accompanying drawings.

Figure 1:
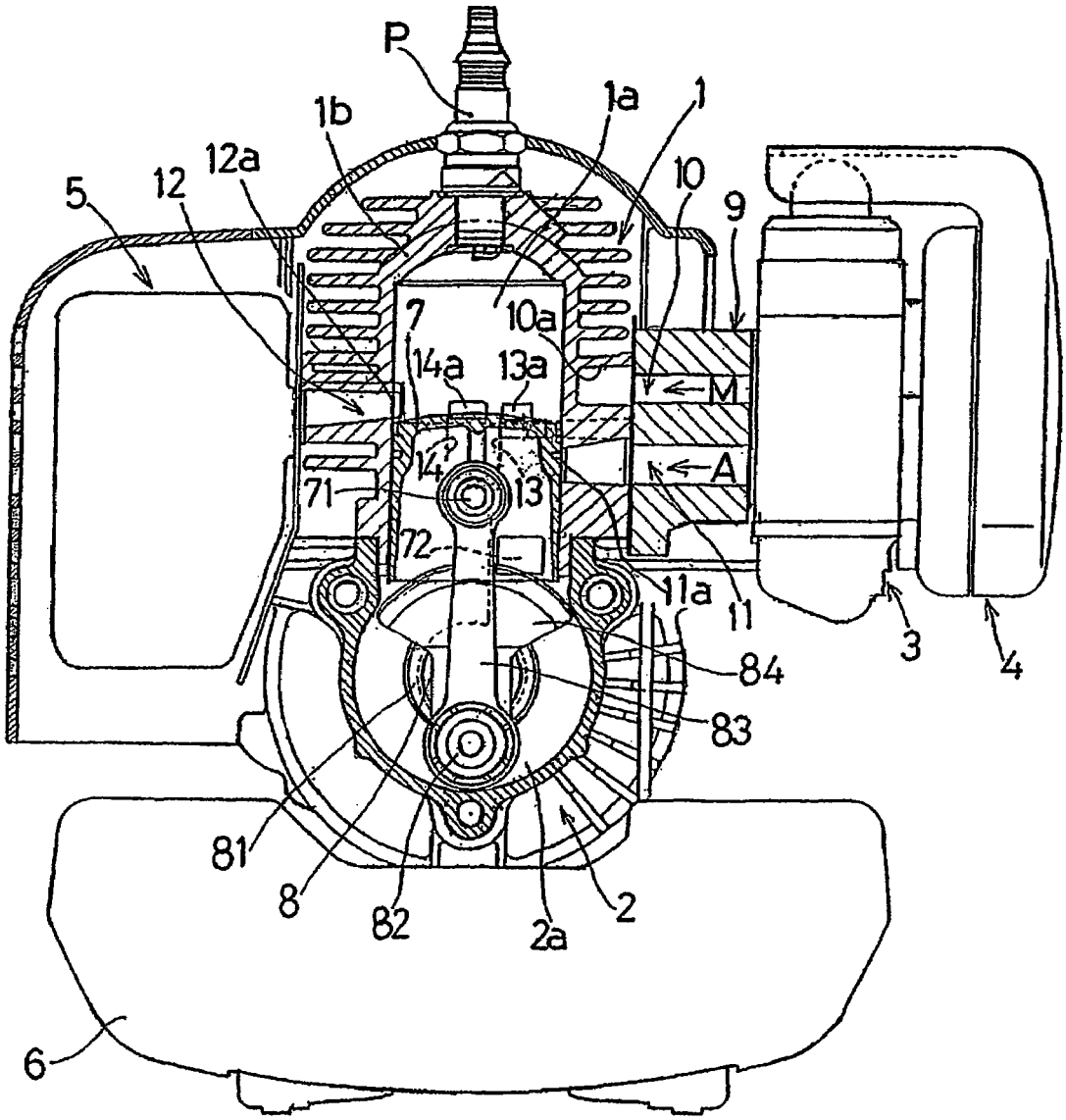
FIG. 1 is a front sectional view of a two-cycle combustion engine according to a first preferred embodiment of the present invention.

Referring to FIG. 1 showing a front sectional view of a two-cycle combustion engine according to a first preferred embodiment of the present invention, a cylinder block 1 having a combustion chamber 1*a* defined therein is fixedly mounted on an upper portion of a crankcase 2. The cylinder block 1 has a side portion (right side portion) to which a carburetor 3 and an air cleaner 4, both forming respective parts of an intake system of the engine, are fluidly connected in series, and also has an opposite side portion (left side portion) to which a muffler 5 forming a part of an exhaust system of the engine is fluidly connected. A fuel tank 6 is secured to a bottom portion of the crankcase 2. The cylinder block 1 is provided with a piston 7 capable of reciprocating in an axial direction (in the embodiment shown, in a vertical direction). A crankshaft 8 is supported within an interior of the crankcase 2 by means of bearings 81. A hollow crankpin 82 is provided at a location offset relative to a longitudinal axis of the crankshaft 8, and the crankpin 82 and a hollow piston pin 71, provided on the piston 7, are connected with each other by a connecting rod 83. In this figure, reference numeral 84 represents crank webs provided on the crankshaft 8. Also, reference character P represents an ignition plug mounted atop the cylinder block 1.

An adaptor 9 is provided between the cylinder block 1 and the carburetor 3, and an air-fuel mixture passage 10 is formed within the cylinder block 1 and respective interiors of the carburetor 3 and the adaptor 9. This passage 10 introduces an air-fuel mixture M into suction chambers 72 defined in a peripheral wall of the piston 7 when, during an intake stroke, the piston 7 nears the top dead center, as will be described later. The air-fuel mixture M introduced into the suction chambers 72 is introduced through first scavenging passages 13, as will be described later, into a crank chamber 2*a* defined within the crankcase 2 and below the cylinder block 1.

Also, in a region below the air-fuel mixture passage 10, an air passage 11 is formed so as to extend parallel thereto, and an air A from this air passage 11 is introduced from an air port 11*a*, opening in an inner peripheral surface of the cylinder block 1, directly into the crank chamber 2*a* during the intake stroke. The carburetor 3 is such as to adjust the respective cross-sectional areas of the air-fuel mixture passage 10 and the air passage 11 by means of a single rotary valve. Also, an exhaust passage 12 having an exhaust port 12*a* opening at the inner peripheral surface of the cylinder block 1 is formed in a peripheral wall of the cylinder block 1, and exhaust gases flowing through this exhaust passage 12 are exhausted to the outside through the muffler 5.

Figure 2:
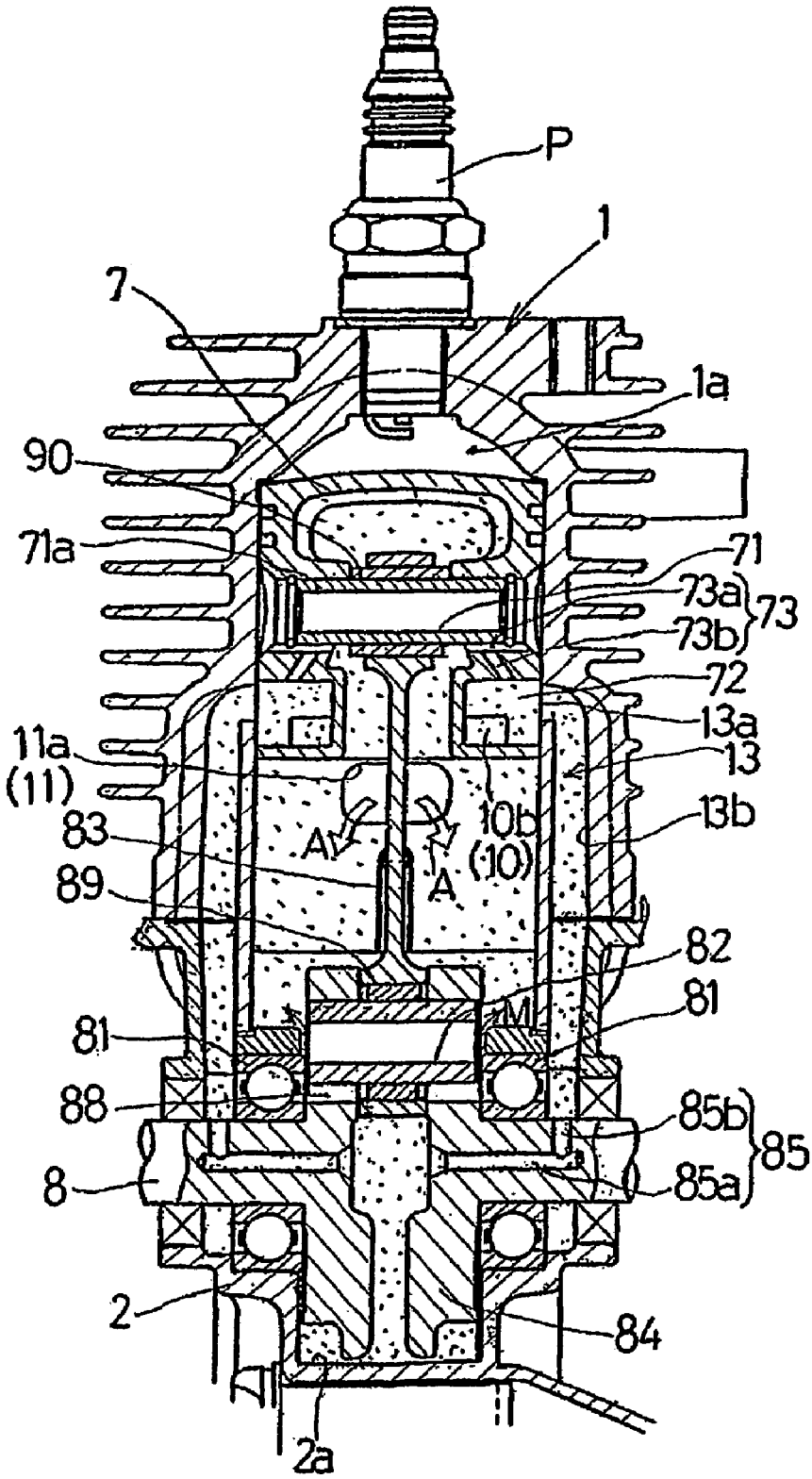
FIG. 2 is a side sectional view of the two-cycle combustion engine during a suction stroke, showing a cylinder block and a crankcase on an enlarged scale and also showing first scavenging passages.
Figure 3:
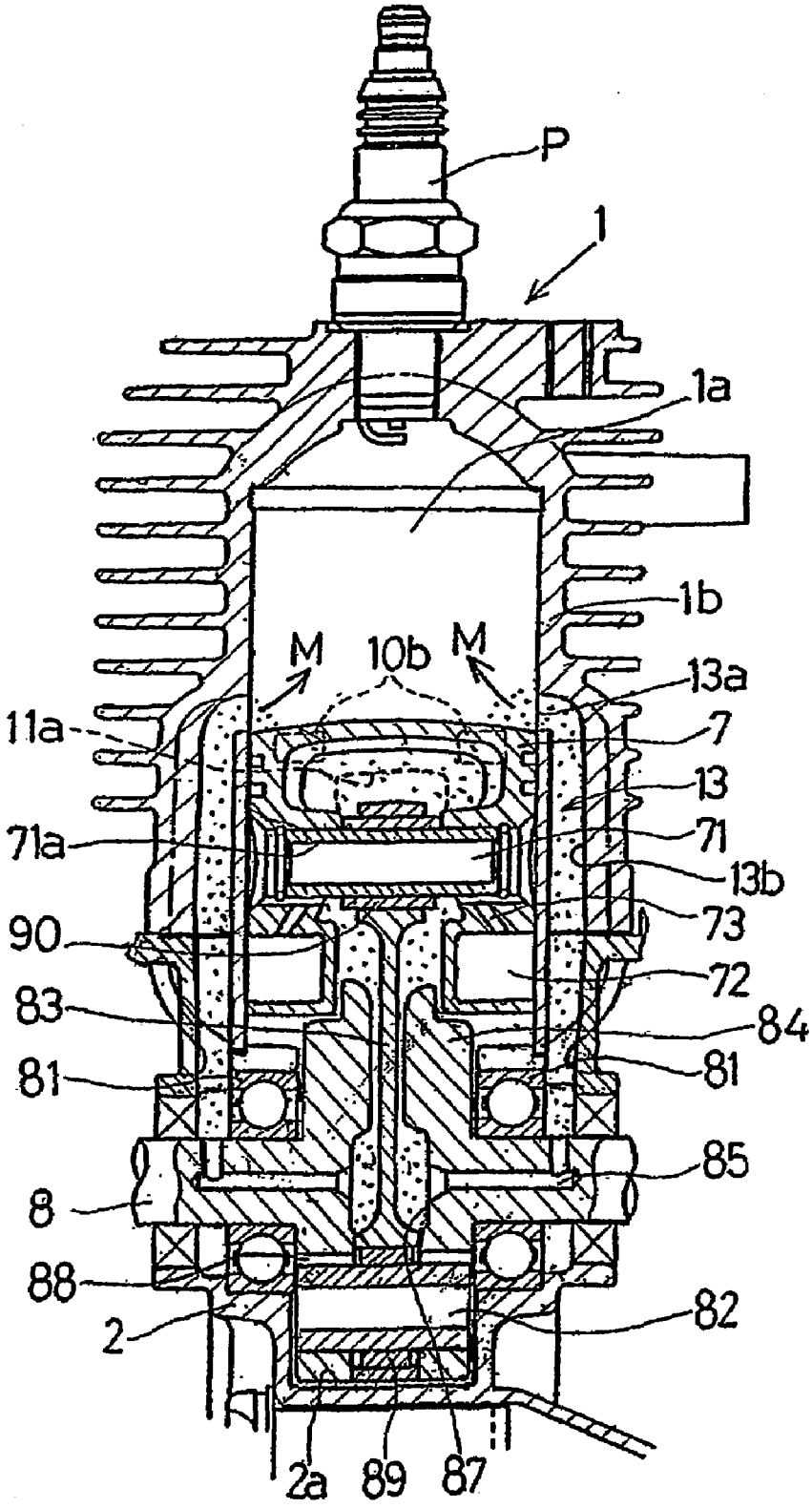
FIG. 3 is a side sectional view of the two-cycle combustion engine of FIG. 2 during a scavenging stroke, showing the cylinder block and the crankcase on an enlarged scale and also showing first scavenging passages employed therein.
Figure 4:
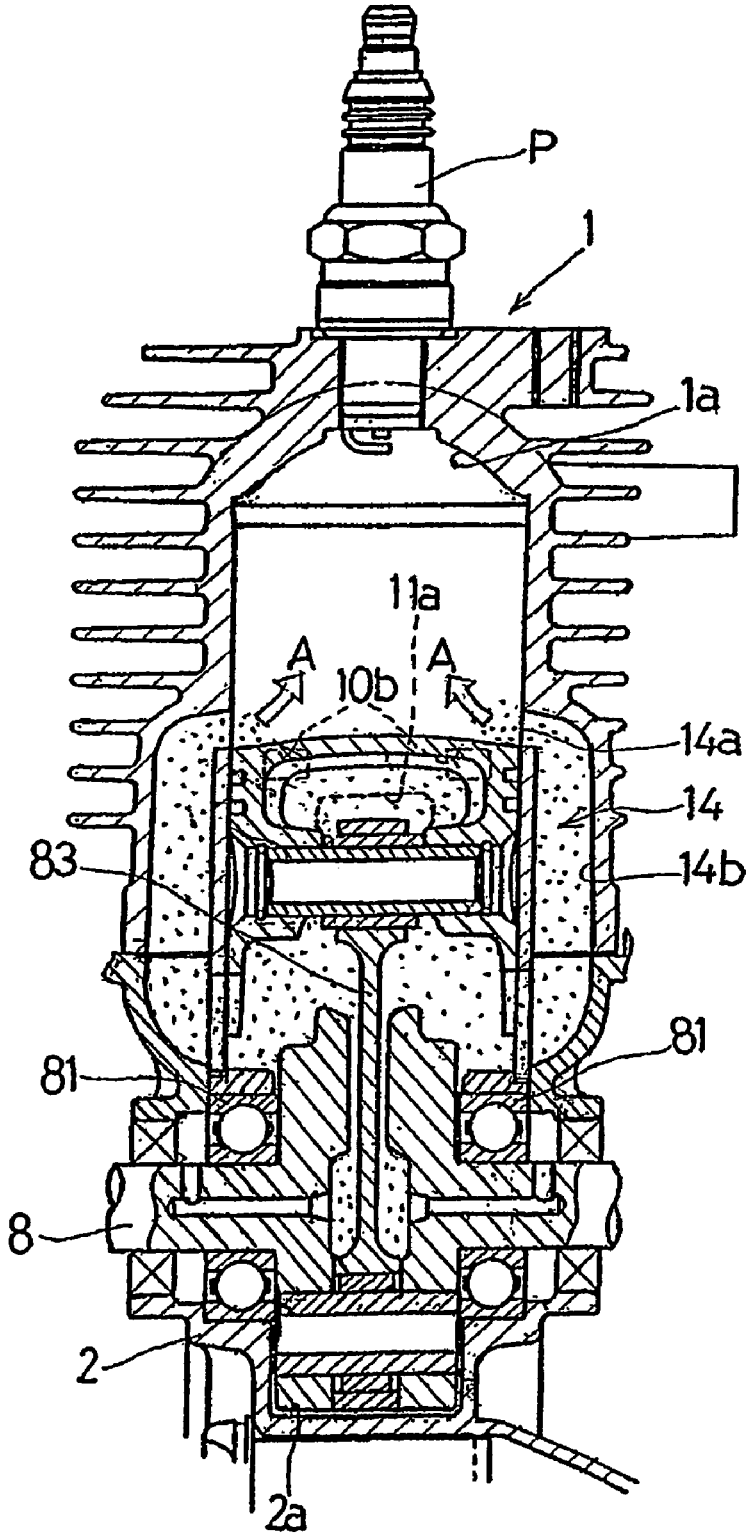
FIG. 4 is a side sectional view of the two-cycle combustion engine, showing the cylinder block and the crankcase on an enlarged scale and also showing second scavenging passages employed therein.

FIGS. 2 to 4 are side sectional views showing the cylinder block and the crankcase on an enlarged scale, in which FIGS. 2 and 3 illustrate the first scavenging passages 13 and FIG. 4 illustrates second scavenging passages 14. In each of those figures, the manner of movement of the air-fuel mixture M and the air A according to the position of the piston is shown, the details of which will be described later. As shown in FIG. 2, the first scavenging passages 13 for introducing the air-fuel mixture M from the air-fuel mixture passage 10 (FIG. 1) are formed within the cylinder block 1 and the crankcase 2. The first scavenging passages 13 fluidly connect between the combustion chamber 1*a* in the cylinder block 1 and the crank chamber 2*a* through the bearings 81 for the crankshaft 8. In other words, each of the first scavenging passages 13 has a first scavenging port 13*a*, opening in the inner peripheral surface of the cylinder block 1 or a cylinder bore, and a communicating passage 13*b* extending vertically from the first scavenging port 13*a* over a bottom end of the cylinder block 1 and down to an outer side face of the adjacent bearing 81, which is situated at a location intermediate of the height of the crankcase 2. During the intake stroke, the air-fuel mixture M introduced from the air-fuel mixture passage 10, shown in FIG. 1, into the suction chambers 72 is introduced from the first scavenging ports 13*a* into the communicating passages 13*b* shown in FIG. 2 and is, after having been caused to flow through respective gaps between inner and outer races of ball bearings employed as the bearings 81 for the crankshaft 8, introduced into the crank chamber 2*a* through respective gaps between the bearings 81 and the crank webs 84 so that the bearings 81 can be lubricated with fuel then contained in the air/furl mixture M. On the other hand, even during a scavenging stroke, some amount of the air-fuel mixture entered the crank chamber 2*a* is introduced into the first scavenging passages 13 through the respective gaps in the bearings 81 and is then utilized to lubricate the bearings 81. The air-fuel mixture M is, as shown in FIG. 3, supplied from the first scavenging passages 13 into the combustion chamber 1*a* above the piston 7.

Also, in the embodiment now under discussion, an oiling passage 85 is formed for fluidly connecting between the crank chamber 2*a* and the first scavenging passages 13 through a hollow of the crank shaft 8 shown in FIG. 2. This oiling passage 85 is made up of first passageways 85*a* extending axially and opening into the crank chamber 2*a* and second passageways 85*b* extending radially so as to fluid connect between the first passageways 85*a* and the first scavenging passages 13, respectively. Yet, a big end bearing (needle bearing) 89 is interposed between a big end of the connecting rod 83 and the crankpin 82, and a portion of the crankshaft 8 in the vicinity of the crankpin 82 is formed with a plurality of circumferentially spaced communicating holes 88 so as to extend axially for fluidly connecting between the big end bearing 89 and the left and right bearings 81. By so doing, the big end bearing 89 can also be lubricated with the air-fuel mixture flowing through the first scavenging passages 13. In addition, a sliding interface between side faces of the big end of the connecting rod 83 and the crankshaft 8 can also be lubricated with the air-fuel mixture M supplied from the first scavenging passages 13 by way of the oiling passage 85.

Furthermore, a lubricating passage 73 is formed for supplying a portion of the air-fuel mixture M within the suction chambers 72 in the piston 7 to a small end bearing 90. As shown in FIG. 2, this lubricating passage 73 is made up of an axially extending lubricating groove 73*a* formed in the piston 7 at a location adjacent an outer periphery of the piston pin 71, and a lubricating hole 73*b* for communicating the suction chambers 72 with the lubricating groove 73*a* With this design, the small end bearing 90 can be lubricated with a portion of the air-fuel mixture introduced into the suction chambers 72 during the intake stroke.

As shown in FIG. 4, the second scavenging passages 14 for the flow of air, which are fluidly connected between the combustion chamber 1*a* and the crank chamber 2*a*, are formed in the cylinder block and the crankcase 2. Each of the second scavenging passages 14 has a second scavenging port 14*a*, opening in the inner peripheral surface of the cylinder block 1 or the cylinder bore, and a communicating passage 14*b* extending vertically from the second scavenging port 14*a* over the bottom end of the cylinder block 1 and opening in an inner peripheral surface of the upper portion of the crankcase 2. The air A introduced from the air port 11*a* into the crank chamber 2*a* is, during the scavenging stroke, injected into the combustion chamber 1*a* through the scavenging ports 14*a* by way of the communicating passages 14*b*.

Figure 5:
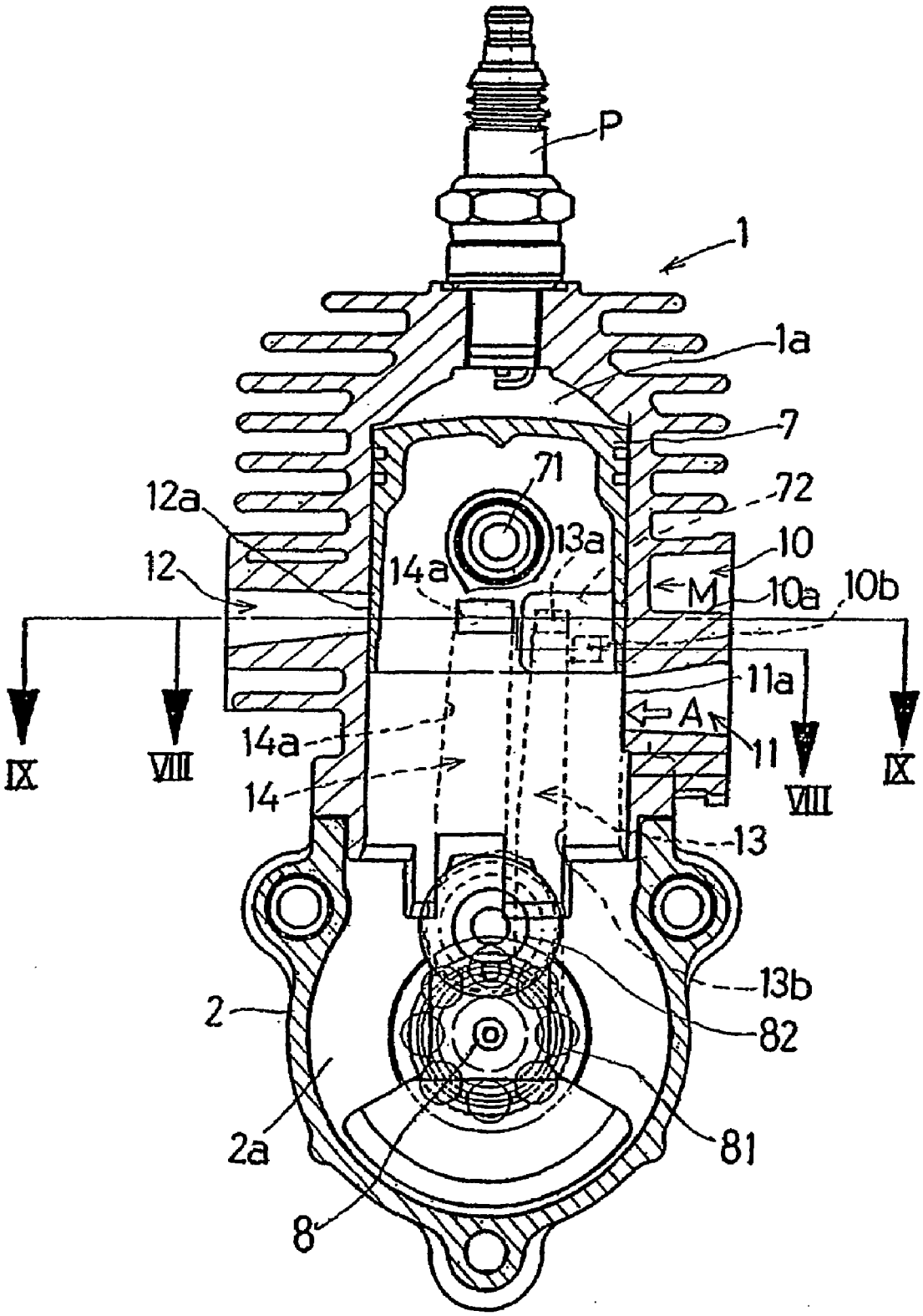
FIG. 5 is a front sectional view of the two-cycle combustion engine, showing the cylinder block and the crankcase on an enlarged scale.

FIG. 5 illustrates a front sectional view with the cylinder block 1 and the crankcase 2 shown on an enlarged scale. As shown therein, the first and second scavenging passages 13 and 14 are employed in a pair, respectively, and extend parallel to each other in the vertical direction, in which the second scavenging port 14*a* defined at an upper end of the second scavenging passage 14 has its upper edge positioned at a level lower than an upper edge of the exhaust port 12*a*. Also, the first scavenging port 13*a* defined at an upper end of the first scavenging passage 13 has its upper edge positioned at a level lower than the upper edge of the adjacent second scavenging port 14*a*.

Figure 6:
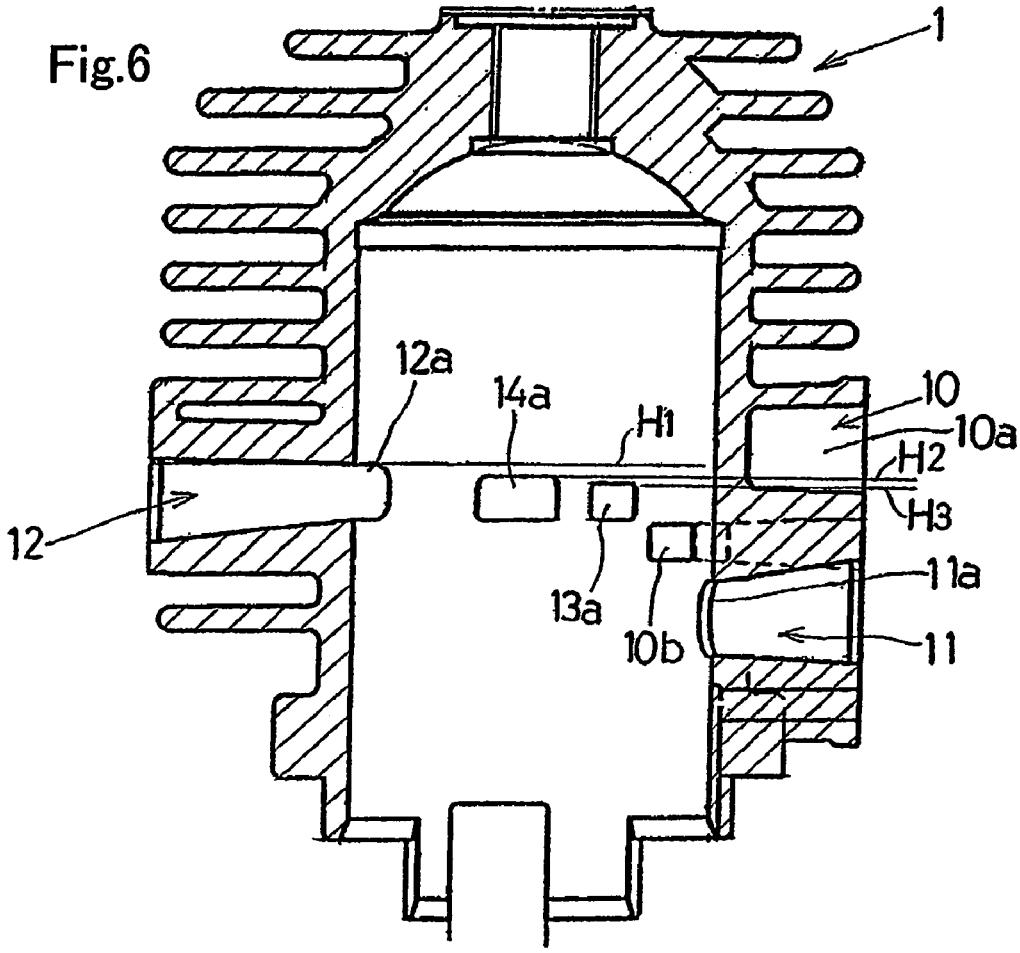
FIG. 6 is a front sectional view, showing the relation in heightwise position between an exhaust port in the cylinder block and the first and second scavenging passages employed therein.

FIG. 6 illustrates a diagram showing the relation in heightwise position between the exhaust port 12*a* and the first and second scavenging ports 13*a* and 14*a*. As shown therein, when respective positions of the upper edges of the exhaust port 12*a*, the second scavenging ports 14*a* and the first scavenging ports 13*a* are expressed by H1, H2 and H3, H1 assumes the highest position, followed by H2 which is in turn followed by H3, in a direction from top. Accordingly, during the scavenging stroke, the air A from the second scavenging ports 14*a* can be injected prior to the air-fuel mixture M from the first scavenging ports 13*a*.

Figure 7:
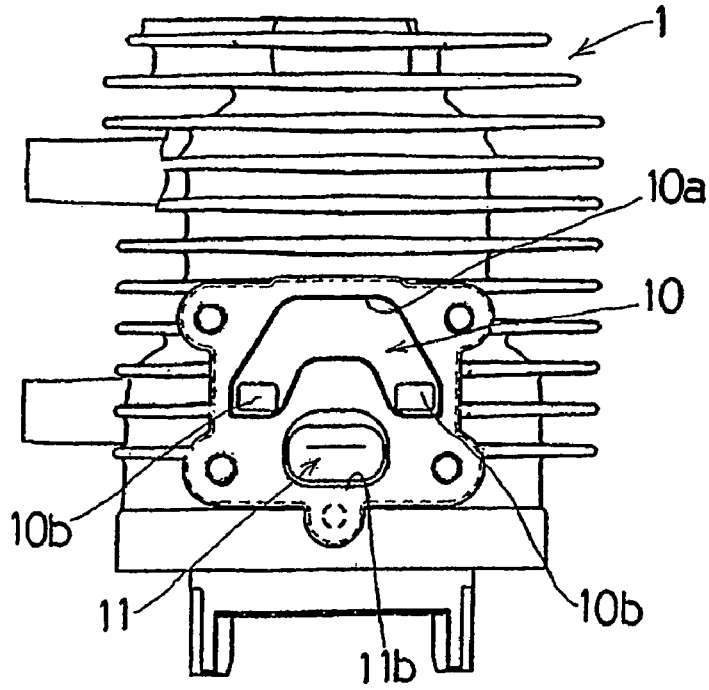
FIG. 7 is a side view, showing the appearance of the cylinder block of the two-cycle combustion engine.

FIG. 7 illustrates a side view showing the appearance of the cylinder block 1. The cylinder block 1 has an outer side portion formed with a cutout 10*a* of a generally inverted V-shape, which forms a part of the downstream region of the air-fuel mixture passage 10. Two air-fuel mixture introducing ports 10*b* and 10*b* capable of opening into the respective suction chambers 72 (FIG. 2) formed in the peripheral wall of the piston 7, when the piston 7 nears the top dead center, are provided in deep inner regions of opposite sides of this cutout 10*a*. Also, at a position below the cutout 10*a*, a cutout or a hole 11*b* forming a part of the air passage 11 is formed, and the air port 11*a* (FIG. 6) opening in the inner peripheral surface of the cylinder block 1 is formed in a deep inner region thereof.

Figure 8:
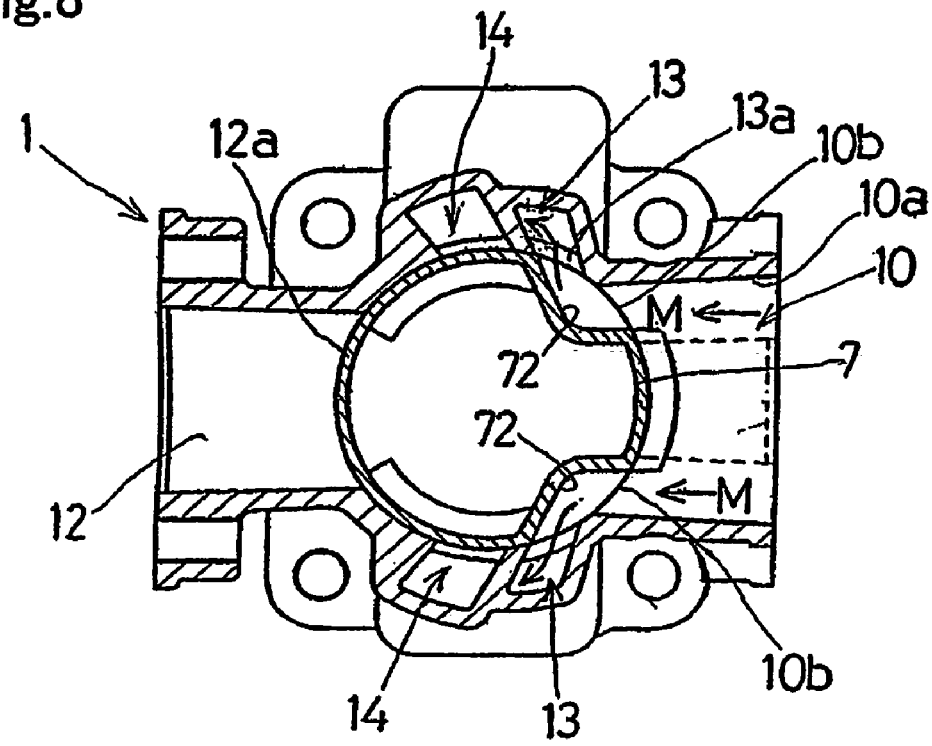
FIG. 8 is a cross-sectional view taken along the line VIII-VIII in FIG. 5.
Figure 9:
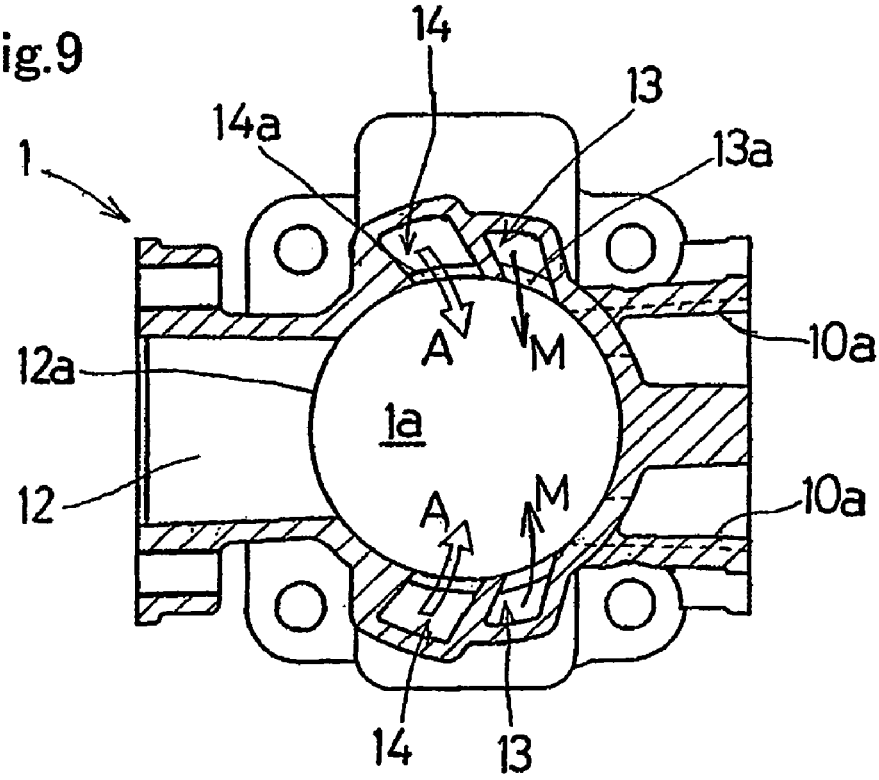
FIG. 9 is a cross-sectional view taken along the line IX-IX in FIG. 5.

FIG. 8 is a cross-sectional view taken along the line VIII-VIII in FIG. 5 and FIG. 9 is a cross-sectional view taken along the line IX-IX in FIG. 5. As shown in FIG. 8, the piston 7 is formed with the pair of the suction chambers 72 formed by depressing respective opposite portions of the peripheral wall of the piston 7 radially inwardly. When during the intake stroke the piston 7 nears the top dead center with the ports 10*b* in the cutout 10*a* of the air-fuel mixture passage 10 aligned with the respective suction chambers 72, the air-fuel mixture M is introduced from the ports 10*b* into the suction chambers 72 and then through the suction chambers 72 into the crank chamber 2*a* by way of the first scavenging ports 13*a* and the communicating passages 13*b* of the first scavenging passages 13, shown in FIG. 2, and the communicating passages 13*b*, respectively. Also, during the scavenging passage in which the piston 7 descends, as shown in FIG. 9, the combustion chamber 1*a* is scavenged with the air A, injected from the second scavenging ports 14*a*, and the air-fuel mixture M injected from the first scavenging ports 13*a* following the injection of the air A.

Hereinafter, the operation of the two-cycle combustion engine of the structure so designed as hereinbefore will be described.

In the first place, when, during the intake stroke, the piston 7 within the cylinder block 1 nears the top dead center as shown in FIG. 2, the pair of the suction chambers 72 defined in the peripheral wall of the piston 7 are communicated with the air-fuel mixture introducing ports 10*b* of the air-fuel mixture passage 10 provided in the cylinder block 1. Also, since during this intake stroke a negative pressure is developed inside the crank chamber 2*a* as a result of the ascending motion of the piston 7, the air-fuel mixture M introduced from the ports 10*b* into the respective suction chambers 72 can be introduced into the first scavenging passages 13 through the first scavenging ports 13*a* and, then, a portion thereof is introduced into the crank chamber 2*a* through the communicating passages 13*b* and the bearings 81 for the crankshaft 8. Accordingly, the bearings 81 can be sufficiently lubricated with a simplified structure, by the fuel contained in the air-fuel mixture M flowing through the bearings 81.

Also, during the intake stroke, as shown in FIG. 2, the air A flowing in the air passage 11 is introduced into the crank chamber 2*a* through the air port 11*a* opening in the inner peripheral surface of the cylinder block 1.

Subsequently and during the scavenging stroke, in which the piston 7 descends towards the bottom dead center, as shown in FIGS. 3 and 4, the air-fuel mixture M and the air A are injected into the combustion chamber 1*a* from the first and second scavenging ports 13*a* and 14*a* of the first and second scavenging passages 13 and 14, respectively. At this time, since as shown in FIG. 6, the respective positions H1, H2 and H3 of the upper edges of the exhaust port 12*a*, the second scavenging ports 14*a* and the first scavenging ports 13*a* are so chosen as to lower in the specific order with H1 assuming the highest position, during the scavenging stroke the air A can be first injected through the second scavenging ports 14*a* as shown by the arrows in FIG. 9, followed by injection of the air-fuel mixture M through the first scavenging ports 13*a*. Also, the air A is injected at a location closer to the exhaust port 12*a* than the location at which the air-fuel mixture M is injected. For this reason, a blow-off of the air-fuel mixture M from the exhaust port 12*a* can be suppressed by the air A first introduced into the combustion chamber 1*a*. Even during this scavenging stroke, the bearings 81 can be lubricated when the air-fuel mixture M somewhat entering the crank chamber 2*a* shown in FIG. 2 returns to the first scavenging passages 13 through the bearings 81.

Figure 10:
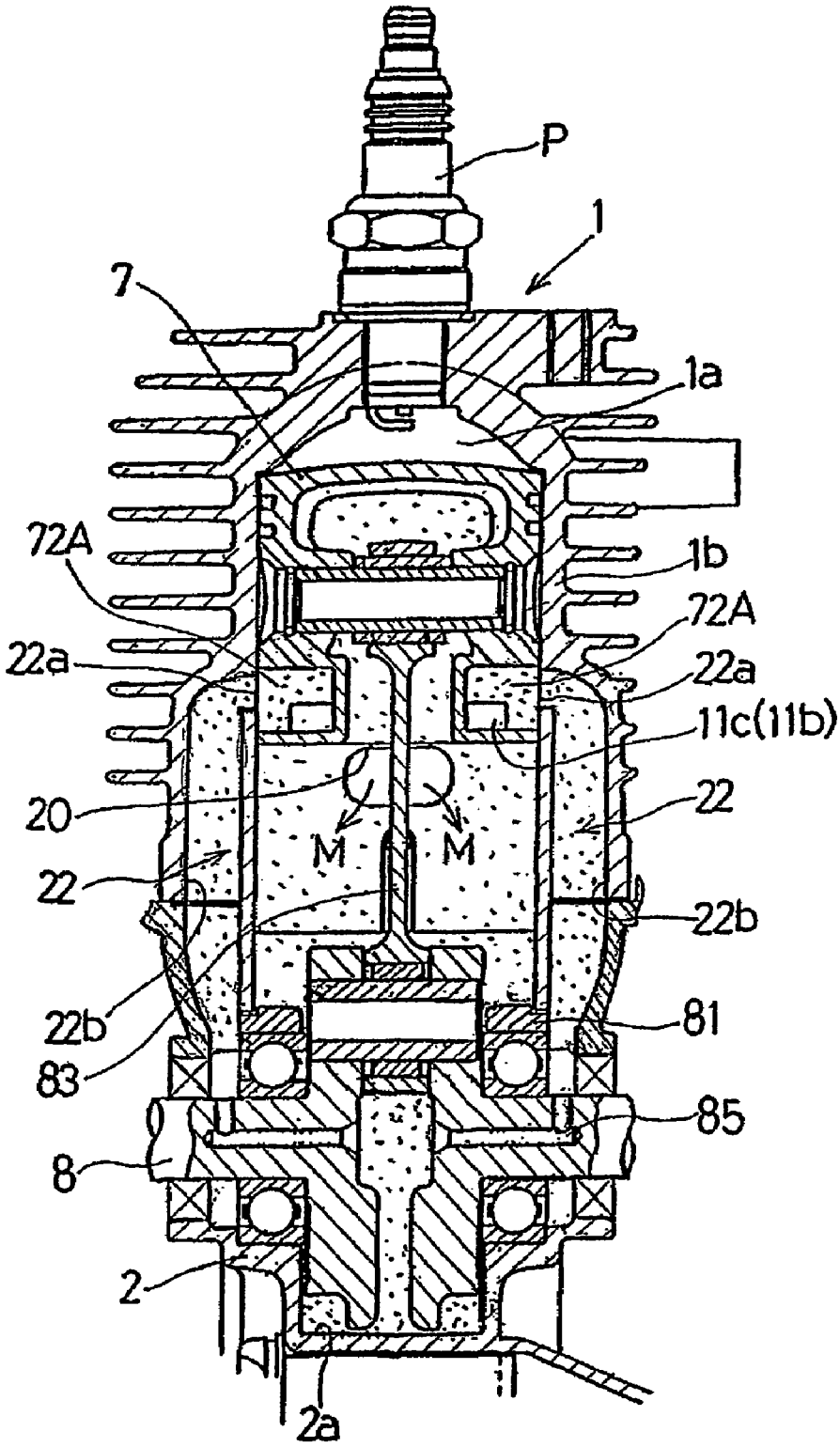
FIG. 10 is a side sectional view of the two-cycle combustion engine in the suction stroke according to a second preferred embodiment of the present invention, showing the second scavenging passages employed therein.
Figure 11:
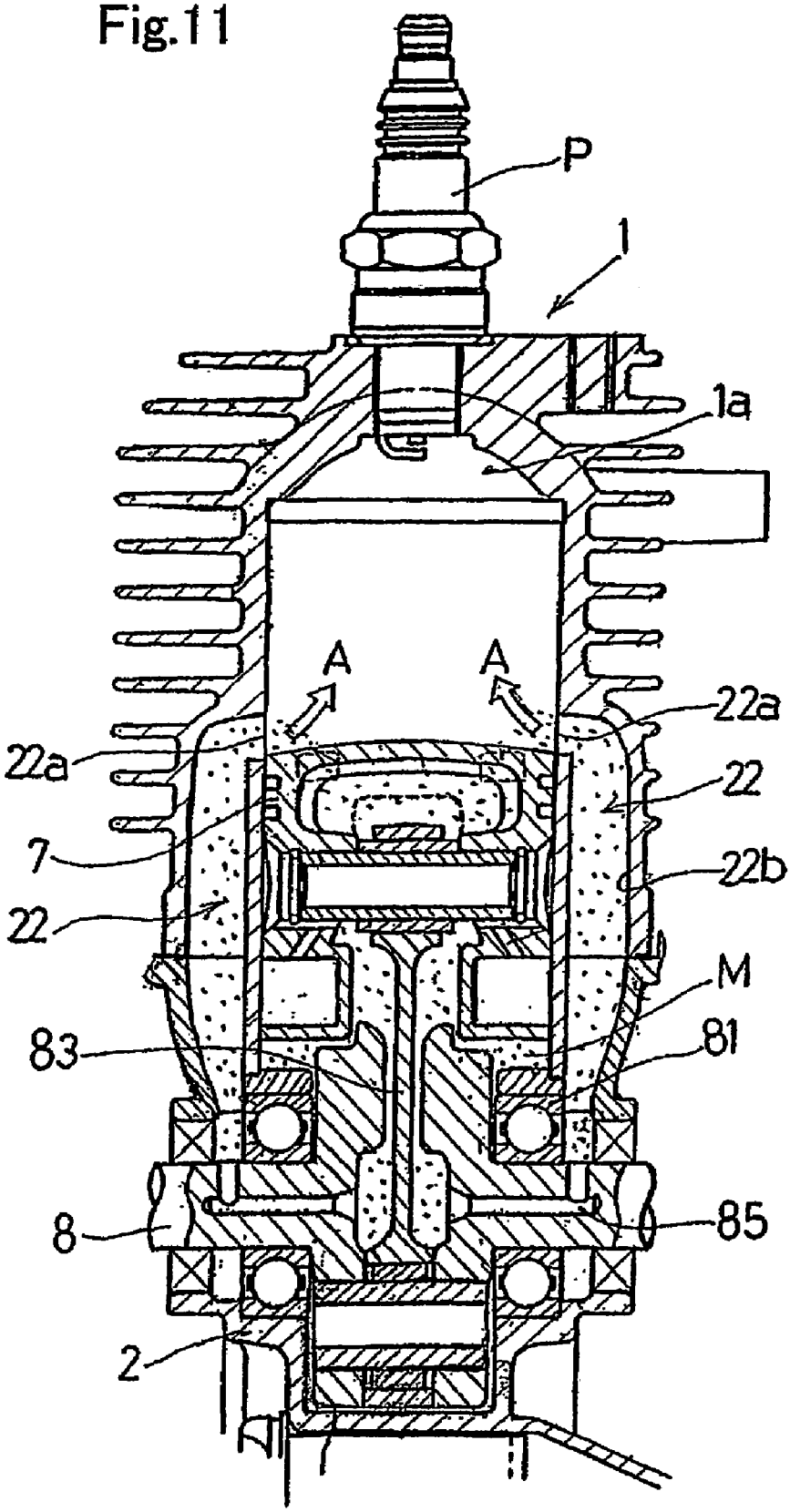
FIG. 11 is a side sectional view of the two-cycle combustion engine of FIG. 10 in the scavenging stroke, showing the second scavenging passages employed therein.
Figure 12:
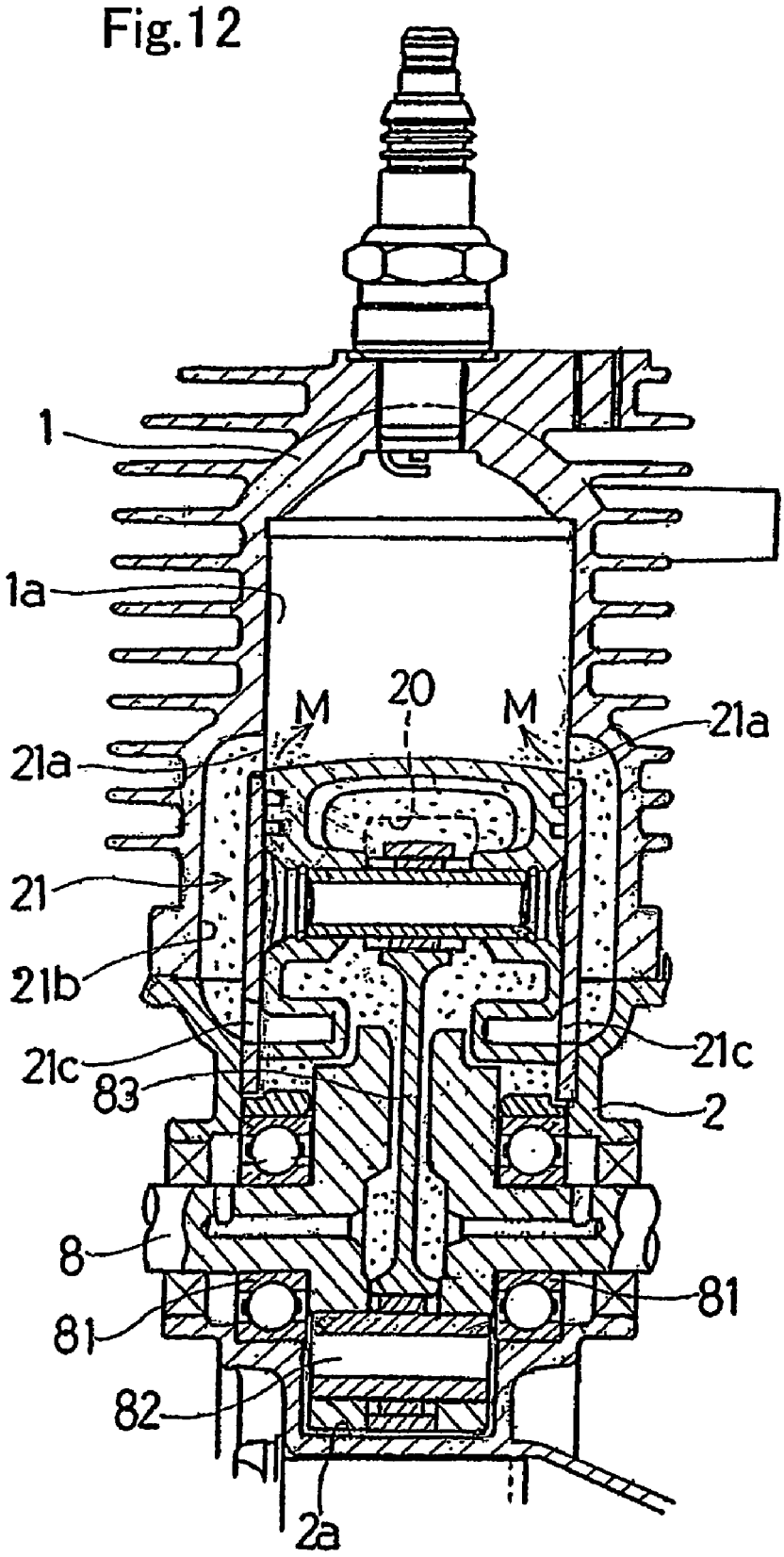
FIG. 12 is a side sectional view of the two-cycle combustion engine of FIG. 10 in the scavenging stroke, showing the first scavenging passages employed therein.

In the next place, the two-cycle combustion engine according to a second preferred embodiment of the present invention will be described. This two-cycle combustion engine according to the second embodiment differs from that according to the first embodiment in that the paths of the air-fuel mixture and the air, respectively, are reversed relative to each other. In other words, except that in the two-cycle combustion engine according to the second embodiment, during the intake stroke the air-fuel mixture M is introduced directly into the crank chamber through the air-fuel mixture passage and on the other hand, the air A is introduced into the second scavenging passages through the air passage, other structural features of the two-cycle combustion engine according to the second embodiment are similar to those according to the first embodiment. FIGS. 10 to 12 illustrate side sectional views of the two-cycle combustion engine with the cylinder block and the crankcase shown on an enlarged scale, in which FIGS. 10 and 11 illustrate particularly second scavenging passages 22 and FIG. 12 illustrates particularly first scavenging passages 21. In each of those figures, the manner of movement of the air-fuel mixture M and the air A according to the position of the piston is shown, the details of which will be described later.

Figure 13:
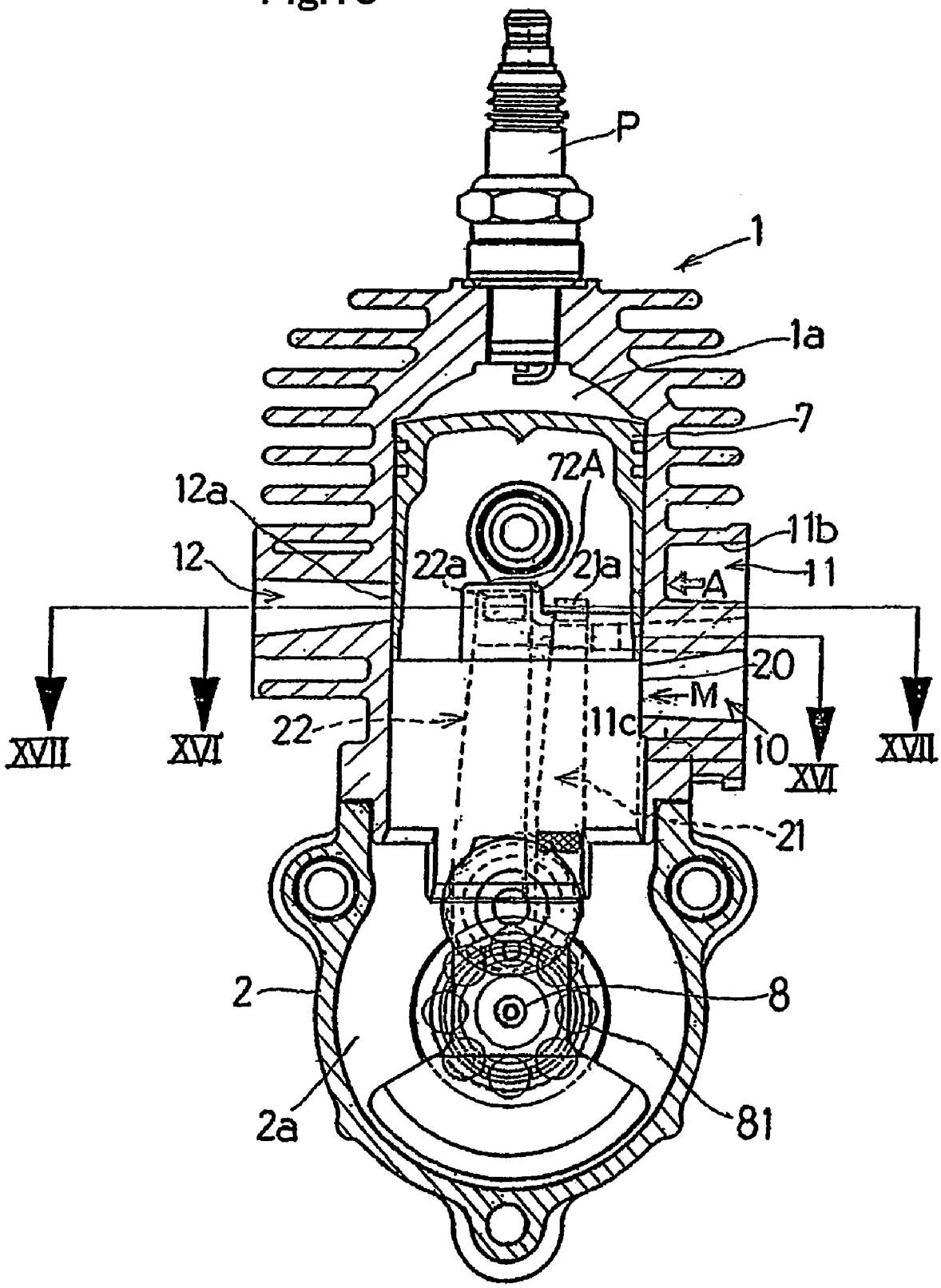
FIG. 13 is a front sectional view of the two-cycle combustion engine of FIG. 10, showing the cylinder block and the crankcase employed therein on an enlarged scale.

In this two-cycle combustion engine, as shown in FIG. 12, within the cylinder block 1 and the crankcase 2, the first scavenging passages 21 for fluidly connecting directly between the combustion chamber 1*a* and the crank chamber 2*a* are provided and, also, as shown in FIG. 10, the second scavenging passages 22 for fluidly connecting between the combustion chamber 1*a* and the crank chamber 2*a* through the bearings 81 for the crankshaft 8 are provided. As shown in FIG. 13, first and second ports 21*a* and 22*a* provided in those first and second scavenging passages 21 and 22, respectively, are so positioned that as is the case with the previously described two-cycle combustion engine, the upper edge of each of the second scavenging ports 22*a* can occupy a position higher than the upper edge of each of the first scavenging ports 21*a* and lower than the exhaust port 12*a*.

Each of the first scavenging passages 21 shown in FIG. 12 has the first scavenging port 21*a* opening in the inner peripheral surface of the cylinder block 1, a communicating passage 21*b* extending vertically from the first scavenging port 21*a* over the bottom end of the cylinder block 1 down to the upper portion of the crankcase 2, and an inflow port 21*c* opening in the inner peripheral surface of the upper portion of the crankcase 2. The air-fuel mixture M introduced into the crank chamber 2*a* is, during the scavenging stroke, injected into the combustion chamber 1*a* from the scavenging ports 21*a* through the communicating passages 21*b*. The air-fuel mixture M is, during the intake stroke, introduced directly into the crank chamber 2*a* from an air-fuel mixture port 20, communicated with the air-fuel mixture passage 10 (FIG. 13) and opening in the inner peripheral surface of the cylinder block 1 as shown in FIG. 13, as shown by the arrows.

When the piston 7 descends down to a position near the bottom dead center, the inflow ports 21*c* shown in FIG. 12 are closed by the peripheral wall of the piston 7 to shut the first scavenging passages 21 to thereby prevent the air-fuel mixture M within the crank chamber 2*a* from entering the combustion chamber 1*a* through the first scavenging passages 21. Accordingly, introduction of the air-fuel mixture M within the crank chamber 2*a* into the combustion chamber 1*a* at the end of the scavenging stroke can be interrupted and, therefore, the blow-off can be further effectively suppressed.

Also, as shown in FIG. 10, each of the second scavenging passages 22 has a second scavenging port 22*a*, opening in the inner peripheral surface of the cylinder block 1, and a communicating passage 22*b* extending vertically from the second scavenging port 22*a* over the bottom end of the cylinder block 1 and down to the outer side face of the adjacent bearing 81, which is situated at a location intermediate of the height of the crankcase 2. The air A introduced from the air passage 11 (FIG. 13) into the second scavenging passages 22 is, during the scavenging stroke, injected into the combustion chamber 1*a* from the scavenging ports 22*a* through the communicating passages 22*b* as shown in FIG. 11.

Figure 14:
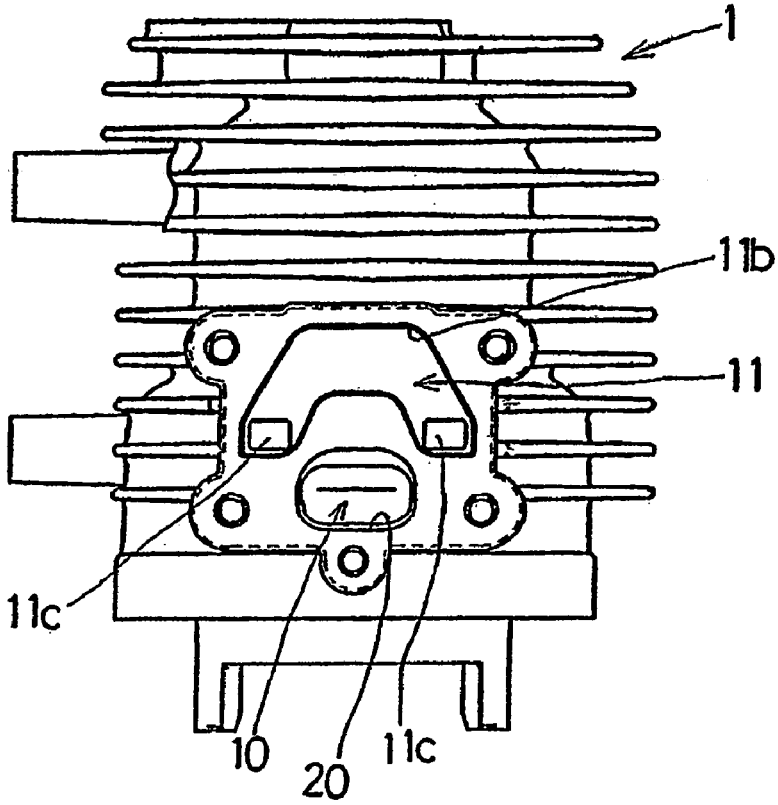
FIG. 14 is a side view showing the appearance of the cylinder block of the two-cycle combustion engine of FIG. 10.

FIG. 14 illustrates a side view showing the appearance of the cylinder block 1. As shown therein, the cylinder block 1 has an outer side portion formed with a cutout 11*b* of a generally inverted V-shape, which forms a part of the air passage 11, and two air introducing ports 11*c* and 11*c* capable of opening into the respective suction chambers 72A (FIG. 10) formed in the peripheral wall of the piston 7, when the piston 7 nears the top dead center, are provided in deep inner regions of opposite sides of this cutout 11*b*. Also, at a position below the cutout 11*b*, an air-fuel port 20 communicated with the air-fuel passage 10 and opening in the inner peripheral surface of the cylinder block 1 is formed.

Figure 15:
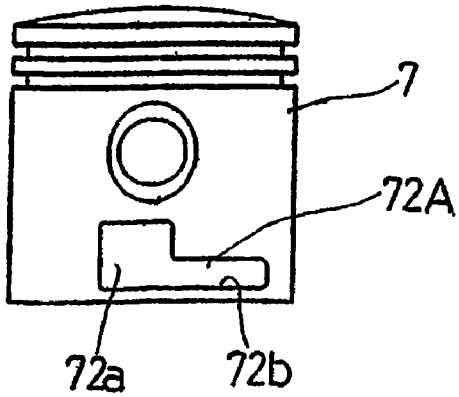
FIG. 15 is a front elevational view of a piston employed in the two-cycle combustion engine of FIG. 10.

FIG. 15 is a front elevational view showing the piston. As shown therein, lower portions of the peripheral wall of the piston 7 are formed with generally L-shaped suction chambers 72A, respectively, each made up of a rectangular recess 72*a* and an elongated groove 72*b* extending from the recess 72*a* in a direction circumferentially of the piston 7.

Figure 16:
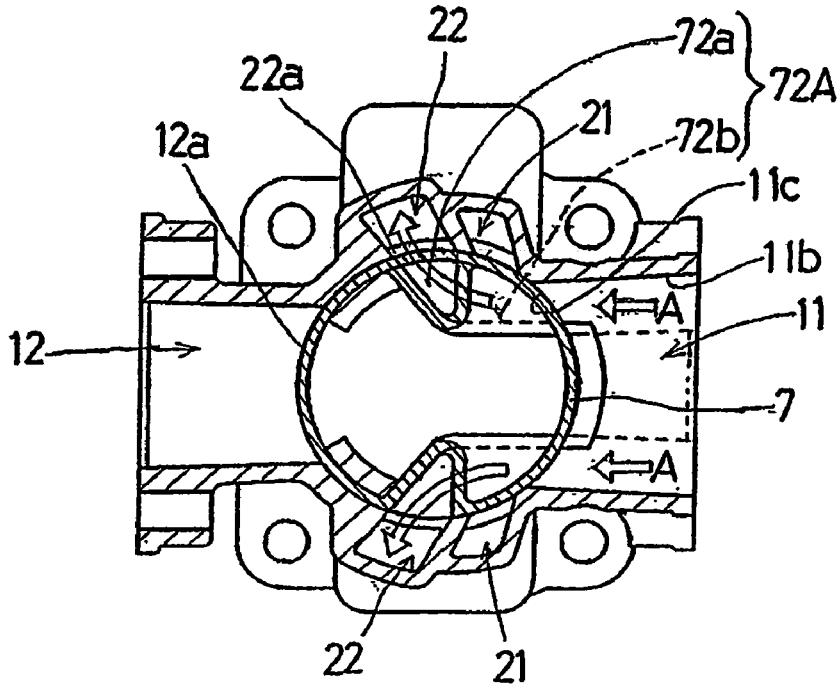
FIG. 16 is a cross-sectional view taken along the line XVI-XVI in FIG. 13.
Figure 17:
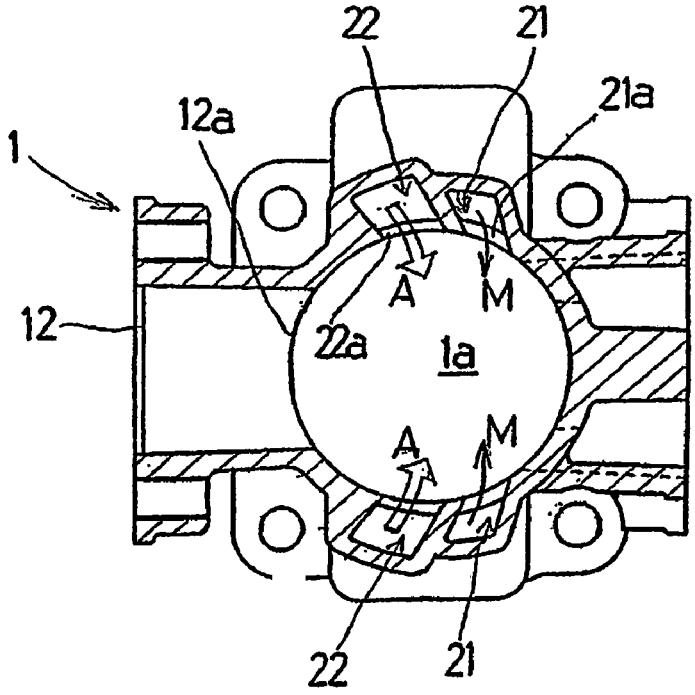
FIG. 17 is a cross-sectional view taken along the line XVII-XVII in FIG. 13.

FIG. 16 is a cross-sectional view taken along the line XVI-XVI in FIG. 13, and FIG. 17 is a cross-sectional view taken along the line XVII-XVII in FIG. 13. As shown in FIG. 16, when the piston 7 nears the top dead center, respective portions of the grooves 72*b* of the suction chambers 72A are aligned with the ports 11*c* of the cutout 11*b* so that the air A introduced into the cutout 11*b* can be introduced from the ports 11*c* to the second scavenging ports 22*a* of the second scavenging passages 22 through the recesses 72*a* of the associated suction chambers 72 as shown by the arrows and be further introduced therefrom into the interiors of the second scavenging passages 22. Also, during the scavenging stroke in which the piston 7 descends, as shown in FIG. 17, the combustion chamber 1*a* is scavenged by the air A, injected through the second scavenging ports 22*a*, and the air-fuel mixture M subsequently injected through the first scavenging ports 21*a* following the air A.

The operation of the two-cycle combustion engine of the structure so designed as hereinbefore will be described.

In the first place, when, during the intake stroke, the piston 7 within the cylinder block 1 nears the top dead center as shown in FIG. 10, the air-fuel mixture M are introduced directly from the air-fuel mixture port 20, opening in the inner peripheral surface of the cylinder block 1, into the crank chamber 2*a*. With this air-fuel mixture M so introduced, the bearings 81 for the crankshaft 8 and the crankpin 82 can be satisfactorily lubricated with a simple structure as is the case with the previously described first embodiment.

Also, during the intake stroke, the suction chambers 72A provided in the piston 7 are communicated with the air introducing ports 11*c* of the air passage 11 provided in the cylinder block 1. Accordingly, by the effect of a negative pressure inside the crank chamber 1*a*, the air A introduced into the cutouts 11*b* is further introduced into the second scavenging passages 22 and the crank chamber 2*a* through the second scavenging ports 22*a*.

Subsequently and during the scavenging stroke, as shown in FIG. 17, the air-fuel mixture M and the air A are injected into the combustion chamber 1*a* from the first and second scavenging ports 21*a* and 22*a* of the first and second scavenging passages 21 and 22, respectively. Specifically, the air A is first injected from the second scavenging ports 22*a* and, thereafter, the air-fuel mixture M is injected from the first scavenging ports 21*a* in a manner delayed relative to the air A. By the effect of the air so introduced prior to the air-fuel mixture M, the blow-off of the air-fuel mixture M through the exhaust port 12*a* can be suppressed. When the air A is injected into the combustion chamber 1*a* through the second scavenging passages 22 shown in FIG. 11, a portion of the air-fuel mixture M within the crank chamber 2*a* flows into the second scavenging passages 22 through the gaps between the inner and outer races of the respective bearings 81. In this way, the bearings 81 can be lubricated with the fuel contained in the air-fuel mixture.

The two-cycle combustion engine according to a third preferred embodiment of the present invention will now be described. The two-cycle combustion engine according to the third embodiment is similar to that according to the previously described second embodiment, but is featured in that in place of the suction chambers 72A defined in the peripheral wall of the piston 7, a reed valve is employed for closing the air passage when the pressure inside the air passage decreases to a value equal to or lower than a predetermined value, and other structural features of the two-cycle combustion engine according to the third embodiment are similar to those according to the second embodiment.

Figure 18:
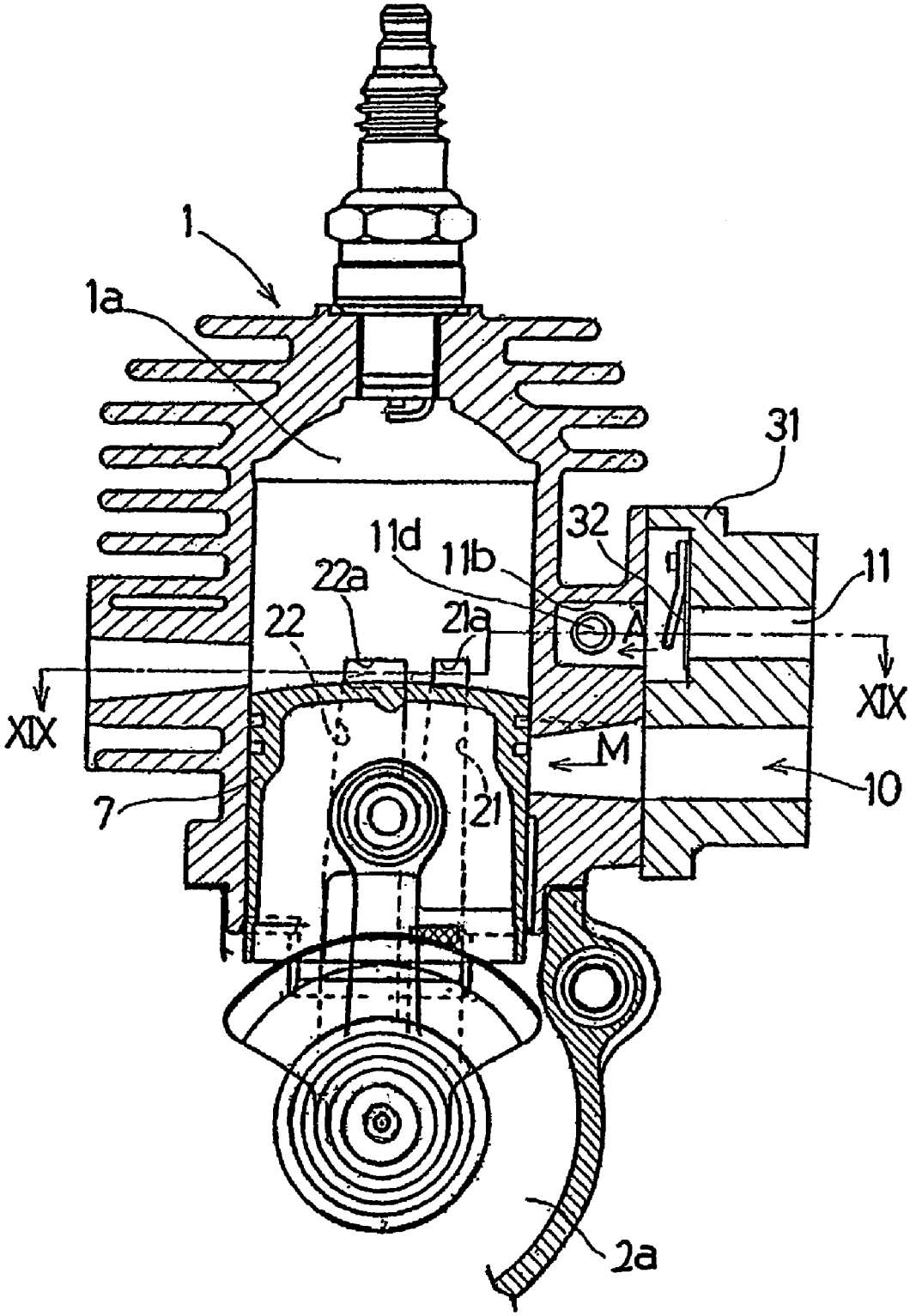
FIG. 18 is a front sectional view of the two-cycle combustion engine according to a third preferred embodiment of the present invention, showing the cylinder block and the piston employed therein.
Figure 19:
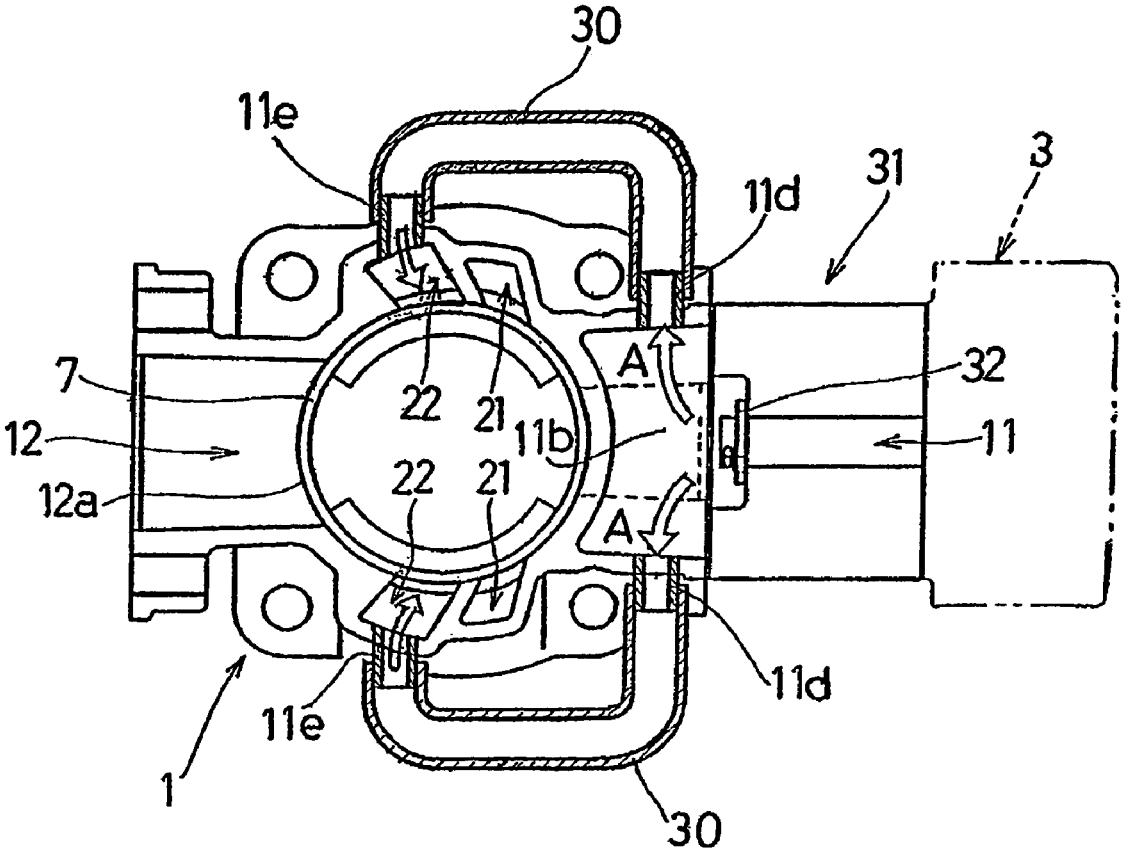
FIG. 19 is a cross-sectional view taken along the line XIX-XIX in FIG. 18.

FIG. 18 is a front sectional view of the two-cycle combustion engine according to the third preferred embodiment of the present invention, showing the cylinder block and the piston employed therein, and FIG. 19 is a cross-sectional view taken along the line XIX-XIX in FIG. 18. As shown in FIG. 18, the piston 7 is not provided with any suction chamber. As shown in FIG. 19, opposite side portions of the cutout 11*b* (FIG. 18) for the air in the cylinder block 1 are provided with respective air introducing ports 11*d* and 11*d*, and respective outer walls of the second scavenging passages 22 are provided with two air discharge ports 11*e* and 11*e*, with the neighboring air introducing and discharge ports 11*d* and 11*e* being fluidly connected with each other by means of respective connecting pipes 30. Also, an adaptor 31 having the air passage 11 defined therein and communicated with the carburetor 3 is fitted to an outer side portion of the cutout 11*b*, and a reed valve 32 for closing the air passage 11 when the pressure inside the air passage 11 decreases down to a value equal to or lower than a predetermined value is fitted to a portion of the interior of the adaptor 31 which confronts the cutout 11*b*.

According to the third embodiment described above, when, during the intake stroke, a negative pressure is developed inside the cylinder block 1 and the crank chamber 2*a* shown in FIG. 10, the reed valve 32 shown in FIG. 18 is opened to allow the air A flowing in the air passage 11 to be introduced into the crank chamber 2*a* through the cutout 11*b*, then through the connecting pipes 30 (FIG. 19) and finally through the associated second scavenging passage 22. Accordingly, while in the two-cycle combustion engine according to the second embodiment, no air is introduced into the second scavenging passages 22 when the suction chambers 72A in the piston 7 leave away from the scavenging ports 22*a* of the second scavenging passage 22 (FIG. 10), the two-cycle combustion engine according to this third embodiment is such that when the reed valve 32 shown in FIG. 18 opens in response to the negative pressure inside the crank chamber 2*a* during the intake stroke, the air A is introduced into the second scavenging passages 22 at all times. For this reason, a sufficient amount of air necessary for the prevention of the blow-off can be secured within the second scavenging passages 22. Also, since no suction chamber 72A is necessary in the piston 7, the passage structure for the introduction of the air can be simplified and the piston 7 can be manufactured light-weight.

Further, the two-cycle combustion engine according to a fourth preferred embodiment of the present invention will now be described. This two-cycle combustion engine is featured in that in the two-cycle combustion engine according to the previously described second embodiment, an air regulating valve capable of closing the air passage when the pressure inside the air passage decreases down to a value equal to or lower than a predetermined value is employed, and other structural features of the two-cycle combustion engine according to the fourth embodiment are similar to those according to the second embodiment.

Figure 20A:
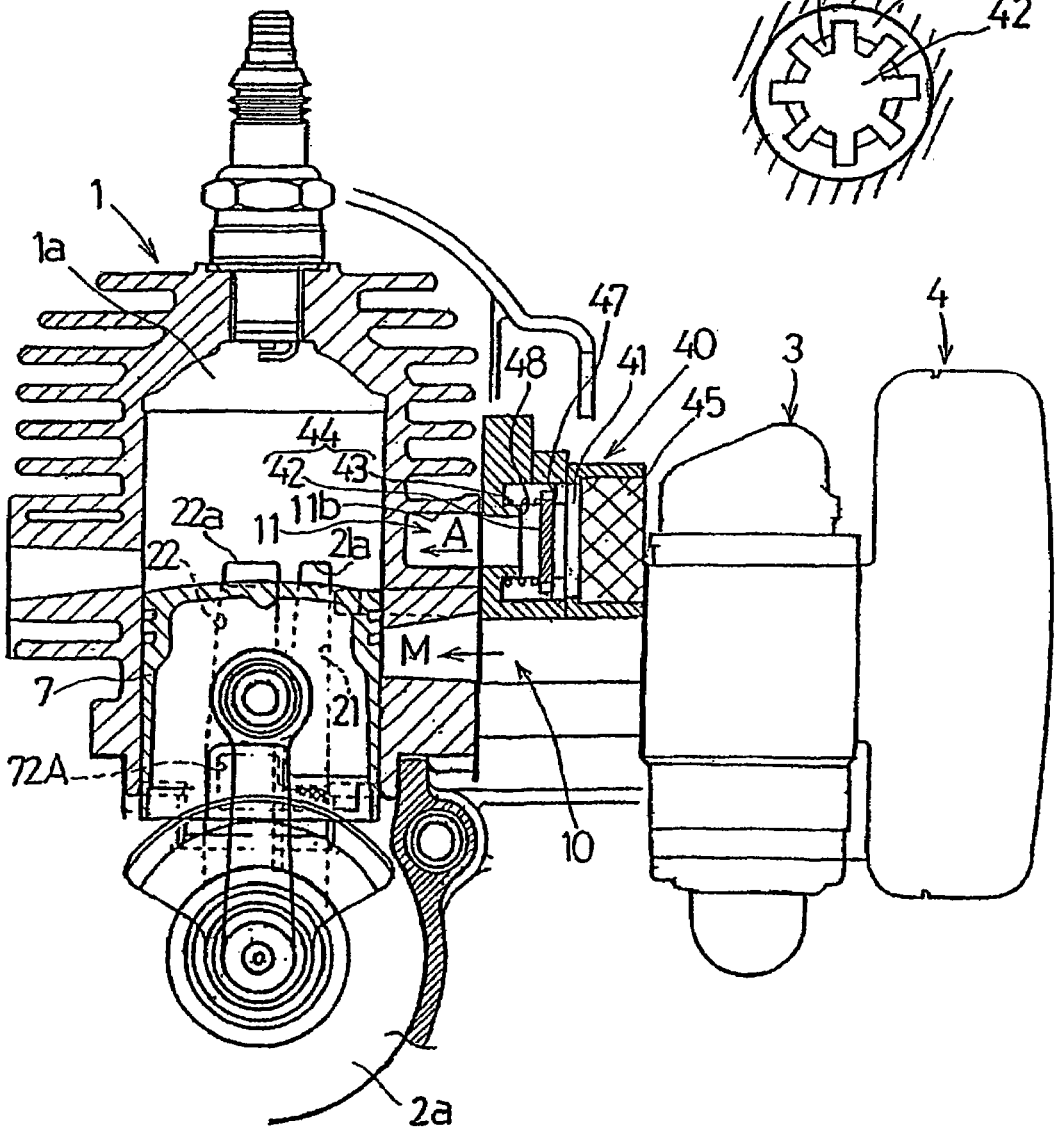
FIG. 20A is a front sectional view of the two-cycle combustion engine according to a fourth preferred embodiment of the present invention.

FIG. 20A is a front elevational view showing, with a portion cut out, the two-cycle combustion engine according to the fourth embodiment. In the two-cycle combustion engine shown therein, the cylinder block 1 has an outer side to which an adaptor 40 having an air-fuel mixture passage 10 defined therein in communication with the carburetor 3 is fitted, and an air introducing passage 41 having an inner end communicated with the cutout 11*b* forming the air passage 11, provided in the cylinder block 1, and an outer end opening towards the atmosphere through an air filter 45 is formed above the air-fuel mixture passage 10 in the adaptor 40. An air regulating valve 44 is provided within the interior of this air introducing passage 41.

Figure 20B:
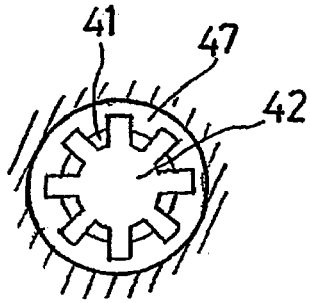
FIG. 20B is a front elevational view showing an air regulating valve employed in the two-cycle combustion engine of FIG. 20A.

The air regulating valve 44 includes a petal-shaped valve body 42 and a coil spring 43 and is so designed that when the pressure inside the air passage 11, which receives a negative pressure inside the crank chamber 1*a*, exceeds a predetermined value or the absolute value of the negative pressure lowers than the absolute value of such predetermined value, the valve body 42 is urged against a stopper 47 by the spring force of the spring 43 to open an outer peripheral portion of the valve body 42 as shown in FIG. 20B so that the air A from the air filter 45 shown in FIG. 20A can be introduced into the air introducing passage 41, the air passage 11, the suction chambers 72A and then the second scavenging passages 22. On the other hand, when the pressure inside the air passage 11 shown in FIG. 20A decreases down to a value lower than the predetermined value, the valve body 42 is urged against a valve seat 48 against the pressing force of the spring 43 by the action of the atmospheric pressure acting from right of the valve body 42 to thereby close the valve with the introduction of the air into the second scavenging passages 22 halted consequently.

It is not generally considered desirable to introduce a large amount of air into the combustion chamber 1*a* during a high boosting such as, for example, an idling, since the amount of the air-fuel mixture within the crank chamber 2*a* generally decreases. With this fourth two-cycle combustion engine, during the high boosting, that is, when the pressure inside the air passage 11 decreases down to a value equal to or lower than the predetermined value, the air passage 11 is closed by the air regulating valve 44 and, therefore, introduction of the air A into the second scavenging passages 22 is interrupted. For this reason, dilution of the air-fuel mixture within the combustion chamber 1*a* during the high boosting such as the idling can be avoided to thereby stabilize the rotation of the two-cycle combustion engine.

The two-cycle combustion engine according to a fifth preferred embodiment of the present invention will now be described. This two-cycle combustion engine is similar to that according to the previously described first embodiment, but is featured in that pairs of second and third scavenging passages having different injecting positions are employed for communicating between the combustion chamber and the crank chamber, and other structural features of the two-cycle combustion engine according to the third embodiment than that mentioned above are similar to those according to the first embodiment.

Figure 21:
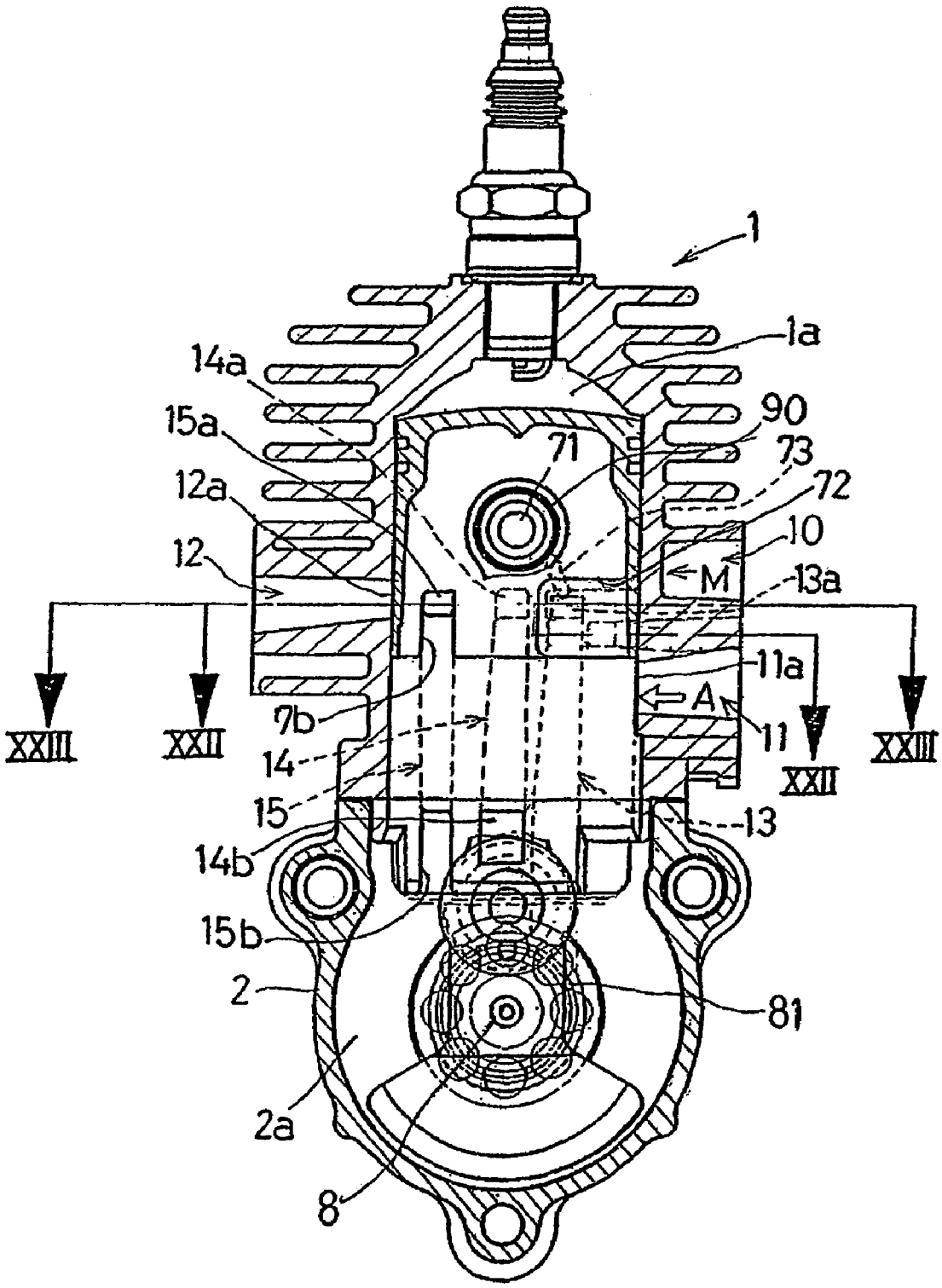
FIG. 21 is a front sectional view of the two-cycle combustion engine according to a fifth preferred embodiment of the present invention, showing the cylinder block and the crankcase employed therein.
Figure 22:
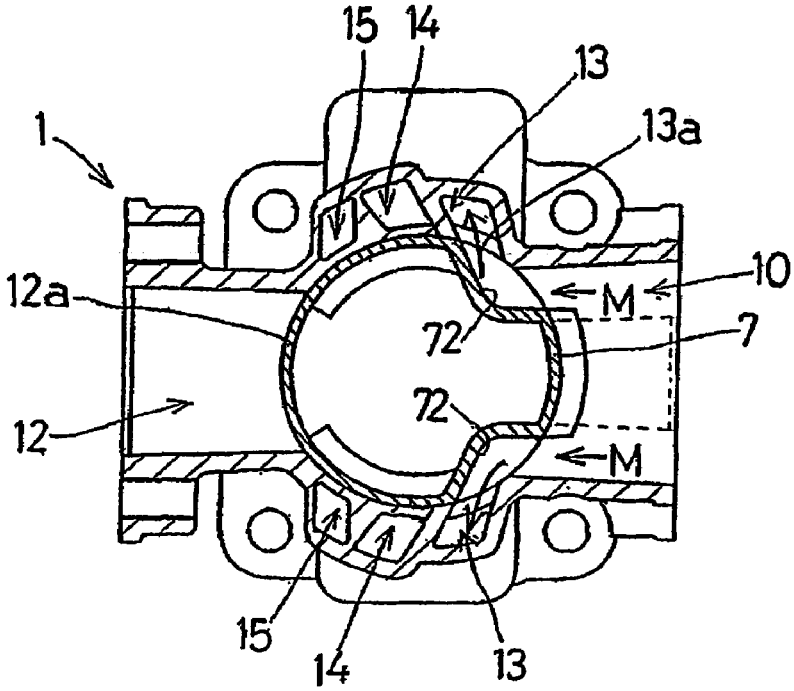
FIG. 22 is a cross-sectional view taken along the line XXII-XXII in FIG. 21.
Figure 23:
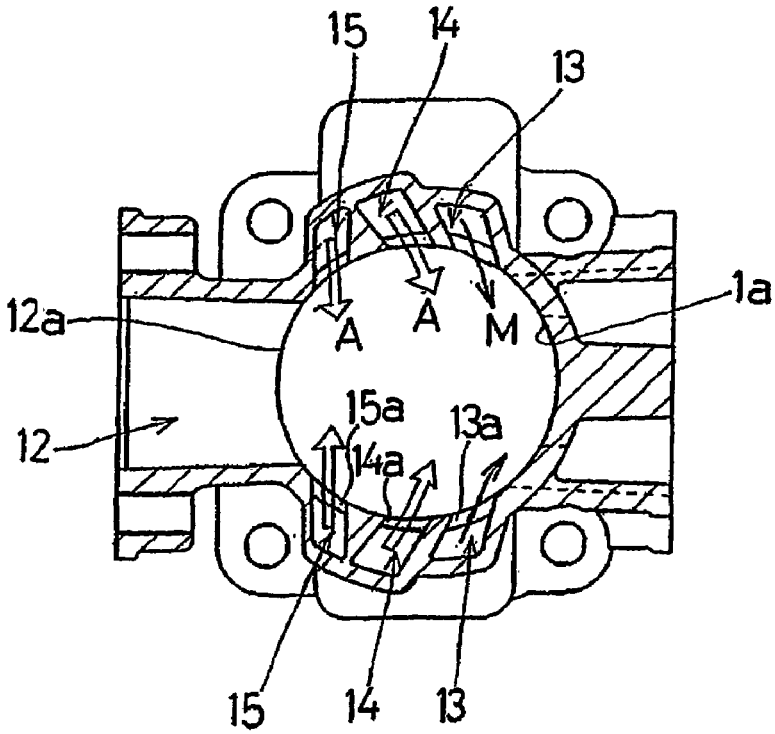
FIG. 23 is a cross-sectional view taken along the line XXIII-XXIII in FIG. 21.

FIG. 21 is a front sectional view showing the cylinder block and the crankcase employed therein, FIG. 22 is a cross-sectional view taken along the line XXII-XXII in FIG. 21 and FIG. 23 is a cross-sectional view taken along the line XXIII-XXIII in FIG. 21. In the two-cycle combustion engine shown in FIG. 21, the cylinder block 1 is formed with the first scavenging passages 13 for fluidly connecting between the combustion chamber 1*a* and the crank chamber 2*a* through the bearings 81 for the crankshaft 8, and respective pairs of second and third scavenging passages 14 and 15 for fluidly connecting directly between the combustion chamber 1*a* and the crank chamber 2*a*.

The first to third scavenging passages 13 to 15 extend substantially vertically in parallel relation to each other and are, as shown in FIGS. 22 and 23, employed in a pair. A second scavenging port 14*a* provided at an upper end of each of the second scavenging passages 14 has an upper edge thereof defined at a position lower than the upper edge of the exhaust port 12*a*, and a first scavenging port 13*a* provided at an upper end of each of the first scavenging passages 13 has an upper edge thereof defined at a position lower than the upper edge of the second scavenging port 14*a*. Also, a third scavenging port 15*a* provided at an upper end of each of the third scavenging passage 15 has an upper edge thereof defined at a position lower than the upper edge of the second scavenging port 14*a*, but at a position level with or slightly lower than the upper edge of the first scavenging port 13*a*.

As shown in FIG. 22, the air-fuel mixture M from the air-fuel mixture passage 10 is introduced from the suction chambers 72, formed in the piston 7, into the first scavenging passages 13. Also, as shown in FIG. 23, the first to third scavenging ports 13*a* to 15*a* of the respective first to third scavenging passages 13 to 15 are formed in the specific order from a position adjacent the air-fuel mixture passage 10 towards a position adjacent the exhaust port 12*a* of the exhaust passage 12, with the third scavenging ports 15*a* of the third scavenging passages 15 opening in the vicinity of the exhaust port 12*a*. In addition, the third scavenging ports 15*a* are so opened that the air A can be injected in the vicinity of the exhaust port 12*a* in a direction perpendicular to a passage center line of the exhaust port 12, whereas the first and second scavenging ports 13*a* and 14*a* are so opened as to inject the air-fuel mixture M and the air A in a direction towards the combustion chamber 1*a* opposite to the exhaust port 12*a*, respectively.

With the fifth two-cycle combustion engine, since prior to the air-fuel mixture M within the first scavenging passages 13 being introduced from the first scavenging ports 13*a* into the combustion chamber 1*a*, the air A within the crank chamber 2*a* is injected from the second scavenging ports 14*a* of the second scavenging passages 14 into the combustion chamber 1*a* and, at the same time as the start of injection of the air-fuel mixture M or thereafter, the air A is injected from the third scavenging ports 15*a* of the third scavenging passages 15 into the combustion chamber 1*a*, the blow-off of the air-fuel mixture can be effectively prevented by the air A fed from the second and third scavenging ports 14*a* and 15*a*. In particular, since the third scavenging ports 15*a* of the third scavenging passages 15 are opened in the vicinity of the exhaust port 12*a* and since the air A from the third scavenging ports 15*a* is injected into the vicinity of the exhaust port 12*a* in a direction perpendicular to the passage center line of the exhaust port 12*a* to thereby interrupt the flow of the air-fuel mixture M towards the exhaust port 12*a*, the blow-off can be further effectively prevented.

Also, in the embodiment of FIG. 21, air ports 14*b* of the second scavenging passages 14 and air inflow ports 15*b* of the third scavenging passages 15 are formed in a lower portion of the cylinder block 1. The air inflow ports 14*b* of the second scavenging passages 14 are closed by the piston 7 when the piston 7 nears the bottom dead center. On the other hand, a lower portion of the piston 7 is formed with cutout grooves 7*b* which open the air inflow ports 15*b* of the third scavenging passages 15, respectively, when the piston 7 nears the bottom dead center.

According to the foregoing construction, when the piston nears the bottom dead center, the air inflow port 14*b*, that is, the second scavenging passages 14 are closed and, on the other hand, in the presence of the cutout grooves 7*b*, the crank chamber 2*a* and the combustion chamber 1*a* are maintained in communication with each other without the third scavenging passages 15 being closed. In other words, since, as the piston 7 approaches the bottom dead center, the pressure inside the crank chamber 2*a* increases, closure of the second scavenging passages 14 with the piston 7 then nearing the bottom dead center is effective to increase the force of injection of the air from the third scavenging ports 15*a* of the third scavenging passages 15 that open at respective locations adjacent the exhaust port 12*a*. For this reason, at the later timing at which the amount of the air-fuel mixture M entering the combustion chamber 1*a* increases, the flow of the air-fuel mixture M towards the exhaust port 12*a* can be blocked and, therefore, the blow-off of the air-fuel mixture M can be further effectively suppressed satisfactorily.

Also, in the embodiment of FIG. 21, as is the case with the embodiment shown in FIG. 2, the piston 7 is formed with a lubricating passage 73 so as to extend from each of the suction chambers 72 to the piston pin 71, so that the fuel contained in the air-fuel mixture M introduced into the suction chambers 72 can be used to lubricate the small end bearing 90 of the piston pin 71.

The two-cycle combustion engine according to a sixth preferred embodiment of the present invention will also be described. This two-cycle combustion engine is similar to that according to the third embodiment, but is featured in that a first reed valve is employed in the air-fuel passage and a second reed valve is employed in the air passage, and other structural features of the two-cycle combustion engine according to the fifth embodiment are similar to those according to the third embodiment.

Figure 24:
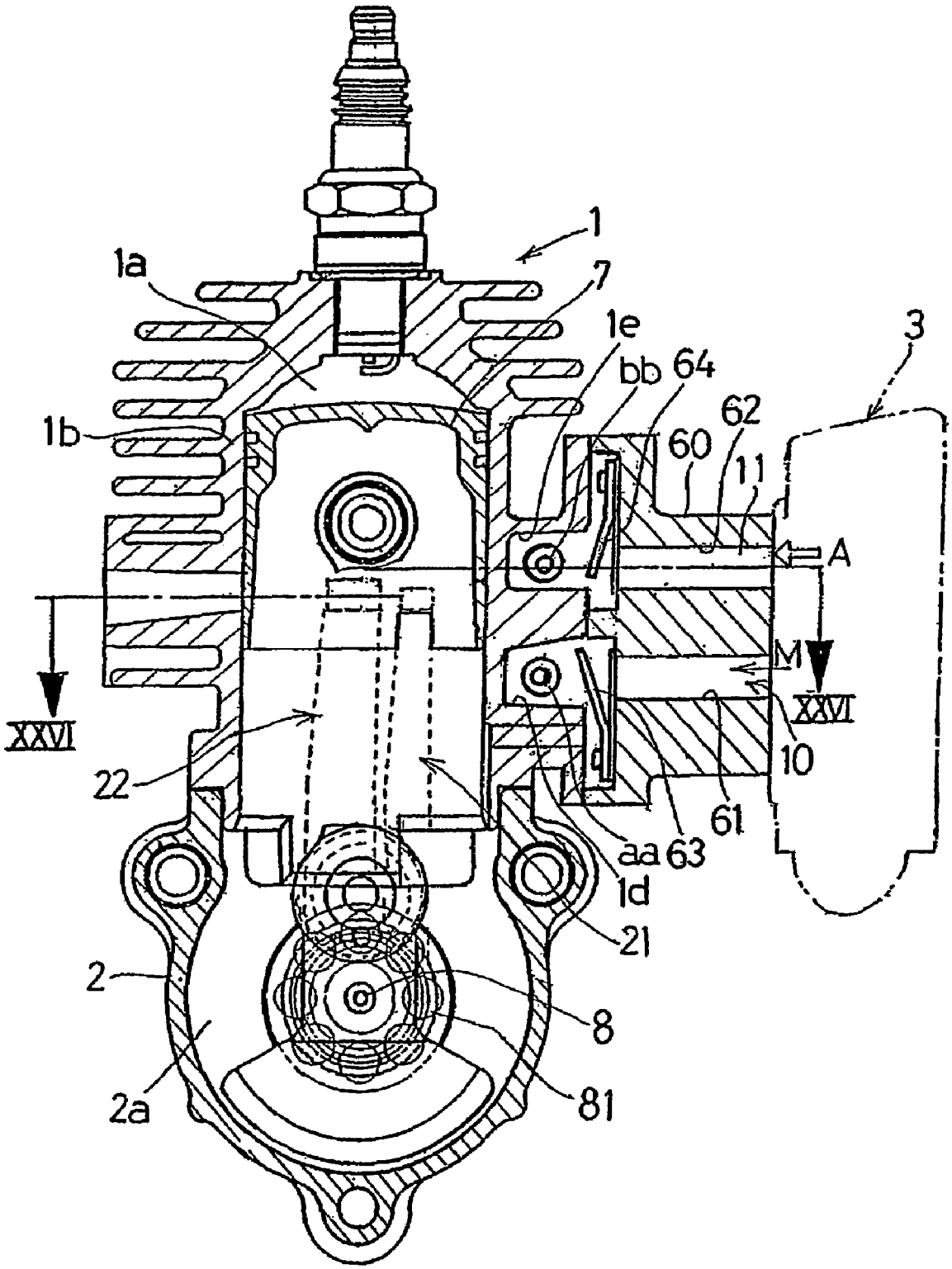
FIG. 24 is a front sectional view of the two-cycle combustion engine according to a sixth preferred embodiment of the present invention, showing the cylinder block and the crankcase employed therein.
Figure 25:
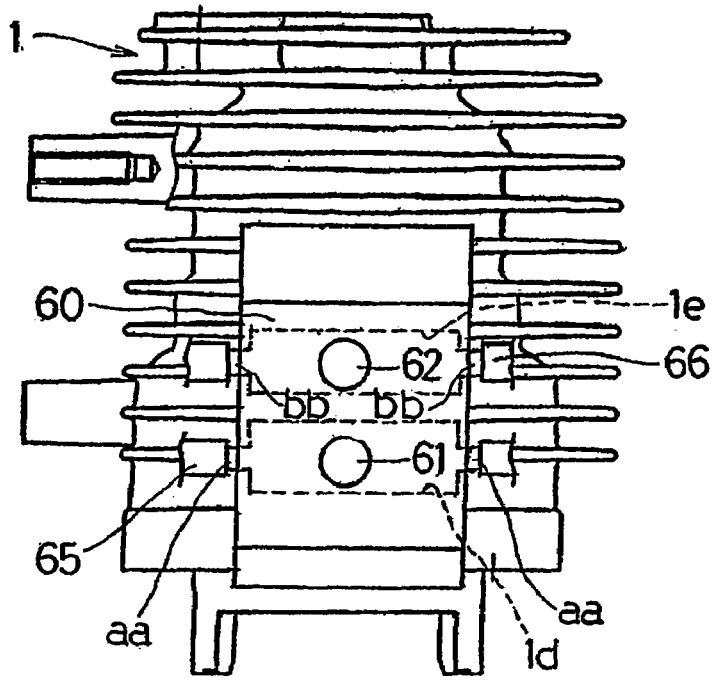
FIG. 25 is a front elevational view, showing the cylinder block of the two-cycle combustion engine of FIG. 24.

FIG. 24 illustrates a front sectional view showing the cylinder block and the crankcase of the two-cycle combustion engine and FIG. 25 illustrates a front elevational view of the cylinder block. In the two-cycle combustion engine shown in FIG. 24, first and second cutouts 1*d* and 1*e* are formed in an outer side face of the cylinder block 1, and an adaptor 60 having first and second passages 61 and 62 forming respective parts of the air-fuel mixture passage 10 and the air passage 11 in cooperation with the cutouts 1*d* and 1*e* is secured to an outside of the cylinder block 1. The carburetor 3 is mounted at a location upstream (right side) of the adaptor 60.

In a region between this adaptor 60 and the cylinder block 1, the first reed valve 63 that opens during the intake stroke is provided between the first cutout 1*d* and the first passage 61, forming a part of the air-fuel mixture passage 10, and the second reed valve 64 that opens during the intake stroke is provided between the second cutout 1*e* and the second passage 62, forming a part of the air passage 11.

Also, as shown in FIG. 25, opposite side walls of the first cutout 1*d* in the cylinder block 1 are formed with respective air-fuel mixture introducing ports aa and aa in opposition to each other and opposite side walls of the second cutout 1*e* in the cylinder block 1 are formed with respective air introducing ports bb and bb in opposition to each other.

Figure 26:
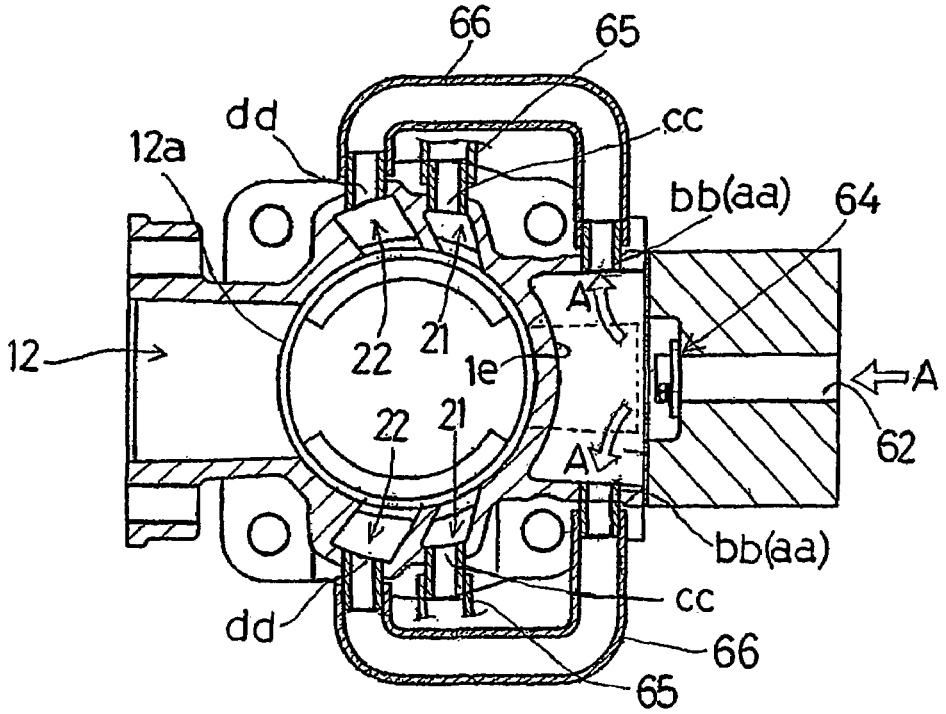
FIG. 26 is a cross-sectional view taken along the line XXVI-XXVI in FIG. 24.

FIG. 26 is a cross-sectional view taken along the line XXVI-XXVI in FIG. 24. As shown therein, air-fuel mixture discharge ports cc and cc are formed in outer side walls of the first scavenging passages 21, respectively, and are fluidly connected with the air-fuel mixture introducing ports aa by means of first connecting pipes 65, respectively. Similarly, air discharge ports dd and dd are formed in outer side walls of the second scavenging passages 22, respectively, and are fluidly connected with the air introducing ports bb by means of second connecting pipes 66, respectively.

Figure 27:
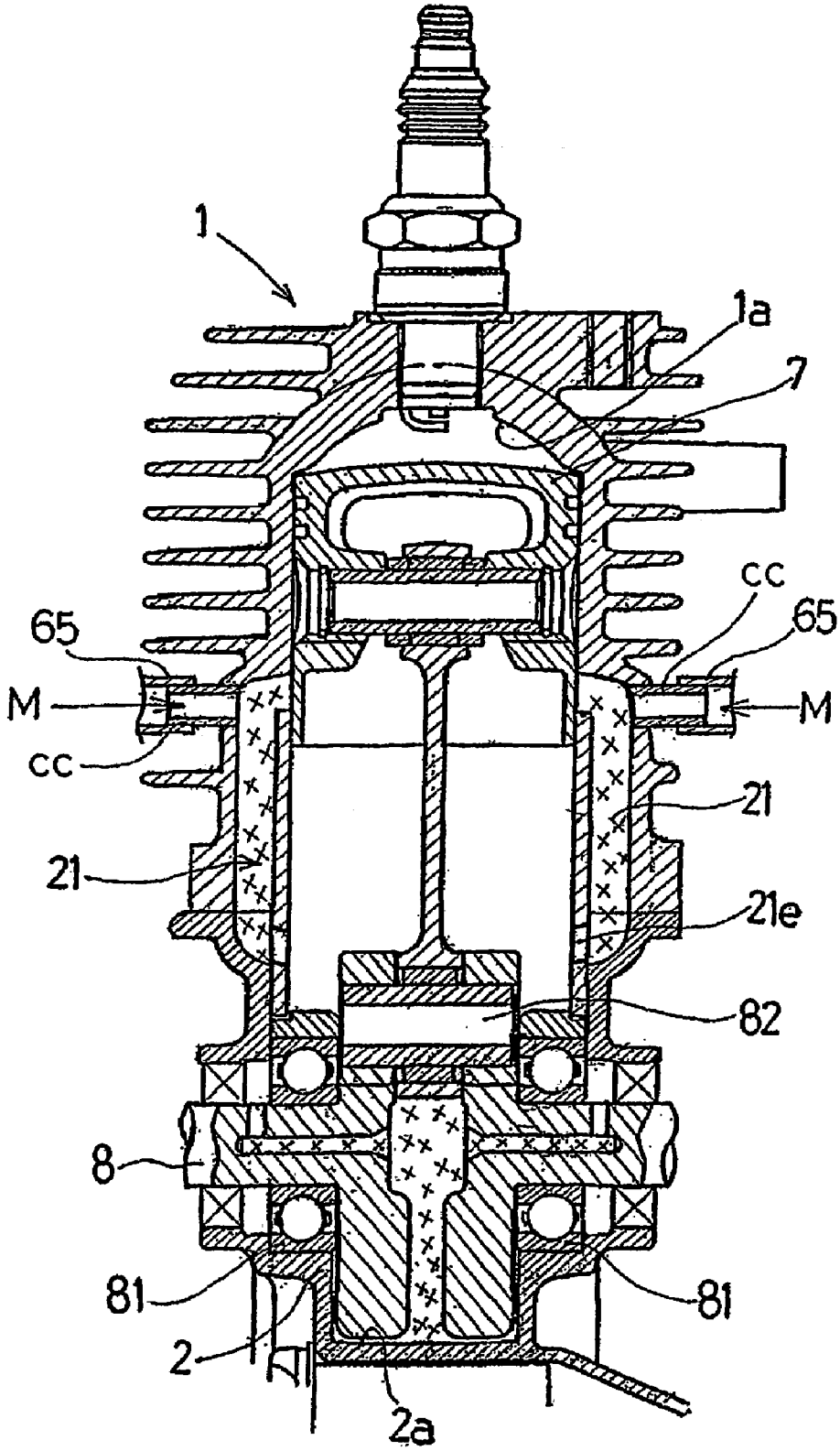
FIG. 27 is a side sectional view of the two-cycle combustion engine of FIG. 24, showing the cylinder block and the crankcase and also showing the first scavenging passages.
Figure 28:
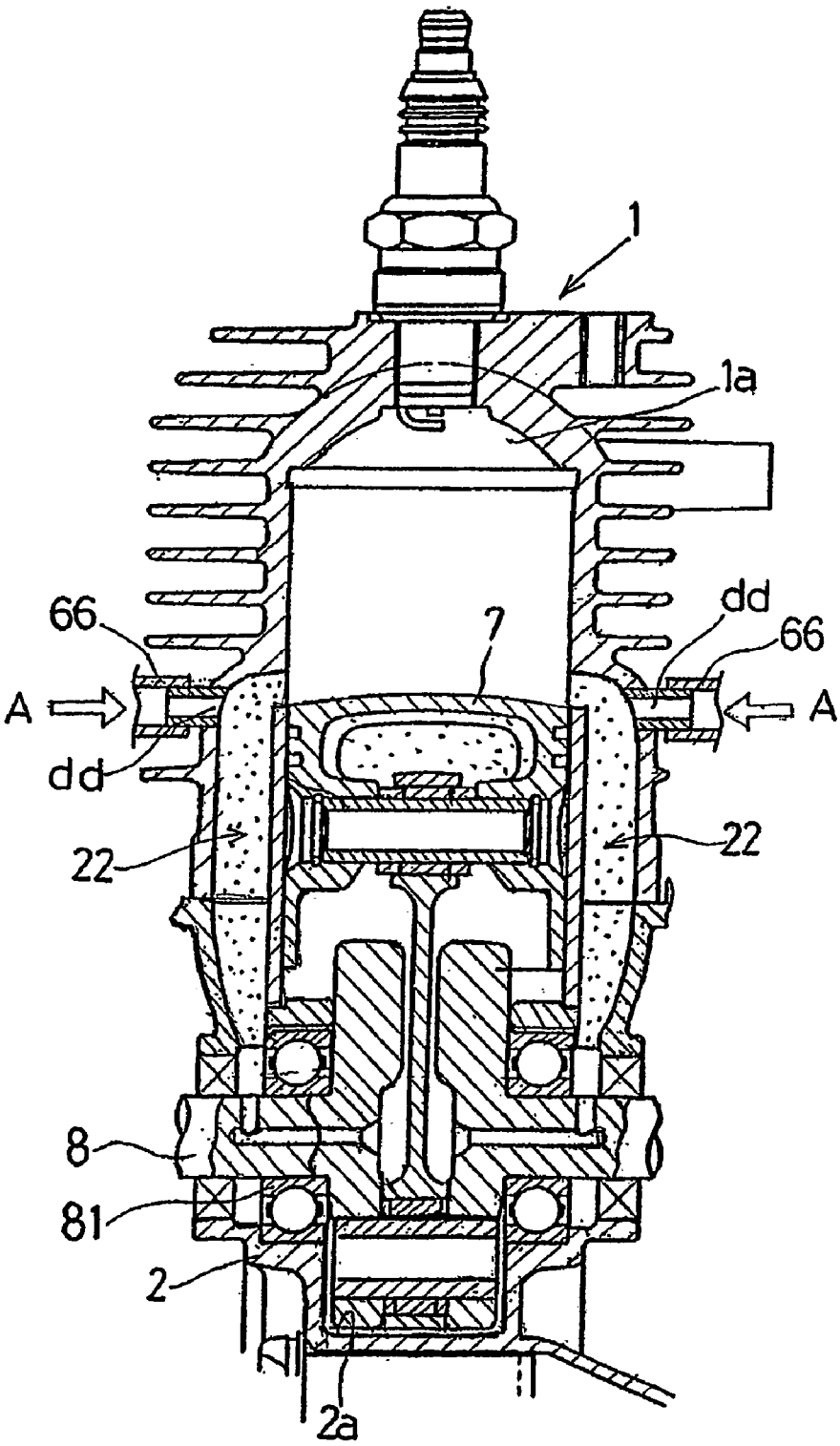
FIG. 28 is a side sectional view of the two-cycle combustion engine of FIG. 24, showing the cylinder block and the crankcase and also showing the second scavenging passages.

FIGS. 27 and 28 are side sectional views showing the cylinder block and the crankcase, in which FIG. 27 illustrates the first scavenging passages 21 and FIG. 28 illustrates the second scavenging passages 22. The air-fuel mixture M introduced from the air-fuel mixture passage 10, shown in FIG. 24, by way of the first reed valve 63 is introduced into the first scavenging passages 21 through the first connecting pipes 65, shown in FIG. 27, and the associated air-fuel mixture discharge ports cc in the cylinder block 1. Also, the air A introduced from the air passage 11, shown in FIG. 24, by way of the second reed valve 64 is introduced into the second scavenging passages 22 through the second connecting pipes 66, shown in FIG. 28, and the associated air discharge ports dd in the cylinder block 1.

According to the foregoing construction, during the intake stroke in which the negative pressure is developed within the crank chamber 2*a* shown in FIG. 24, the first reed valve 63 in the air-fuel mixture passage 10 is opened with the air-fuel mixture M consequently introduced into the first cutout 1*d* through the first passage 61 in the adaptor 60 and then into the first scavenging passages 21 through the associated first connecting pipes 65 shown in FIG. 27. A portion of the air-fuel mixture M so introduced into the first scavenging passages 21 enters the crank chamber 2*a* from inflow ports 21*e*. The second scavenging passages 22 shown in FIG. 28 are communicated with the crank chamber 2*a* through respective gaps between inner and outer races of the bearings 81. Accordingly, when the piston 7 descends during the scavenging stroke, the air-fuel mixture M within the crank chamber 2*a* lubricates the bearings 81 as it enters the second scavenging passages 22 through the bearings 81. Also, during the intake stroke, the second reed valve 64 provided in the air passage 11 shown in FIG. 24 is also opened, allowing the air A from the second passage 62 in the adaptor 60 to be introduced into the second cutout 1*e* and then into the second scavenging passages 22 through the associated second connecting pipes 66 shown in FIG. 28.

Therefore, only principally necessary amounts of the air-fuel mixture M and the air A shown in FIG. 24 can be allowed to fill up the first and second scavenging passages 21 and 22, respectively. For this reason, it is possible to prevent the blow-off of an excessively enriched air-fuel mixture from entering the combustion chamber 1*a* at the end of the scavenging stroke and then blowing off through the exhaust port 12*a*. Also, during the scavenging stroke, the air A introduced into the second scavenging passages 22 shown in FIG. 28 is first injected into the combustion chamber 1*a*, followed by the air-fuel mixture M being injected through the first scavenging passages 21 shown in FIG. 27. Since at this time the air-fuel mixture M behaves in such a manner that the enriched air-fuel mixture within the first scavenging passages 21 enters the combustion chamber 1*a* and, thereafter, the air-fuel mixture M within the crank chamber 2*a*, which is a leaned air-fuel mixture, enters the combustion chamber 1*a* through the first scavenging passages 21, the blow-off of the enriched air-fuel mixture can be avoided with the charging efficiency increased consequently.

The two-cycle combustion engine according to a seventh preferred embodiment of the present invention will furthermore be described. This two-cycle combustion engine is similar to that according to the third embodiment, but is featured in that as principal bearings for supporting the crankshaft 8, needle bearings 51 are employed, and other structural features of the two-cycle combustion engine according to the seventh embodiment except a lower end position of the scavenging passages are similar to those according to the third embodiment.

Figure 29:
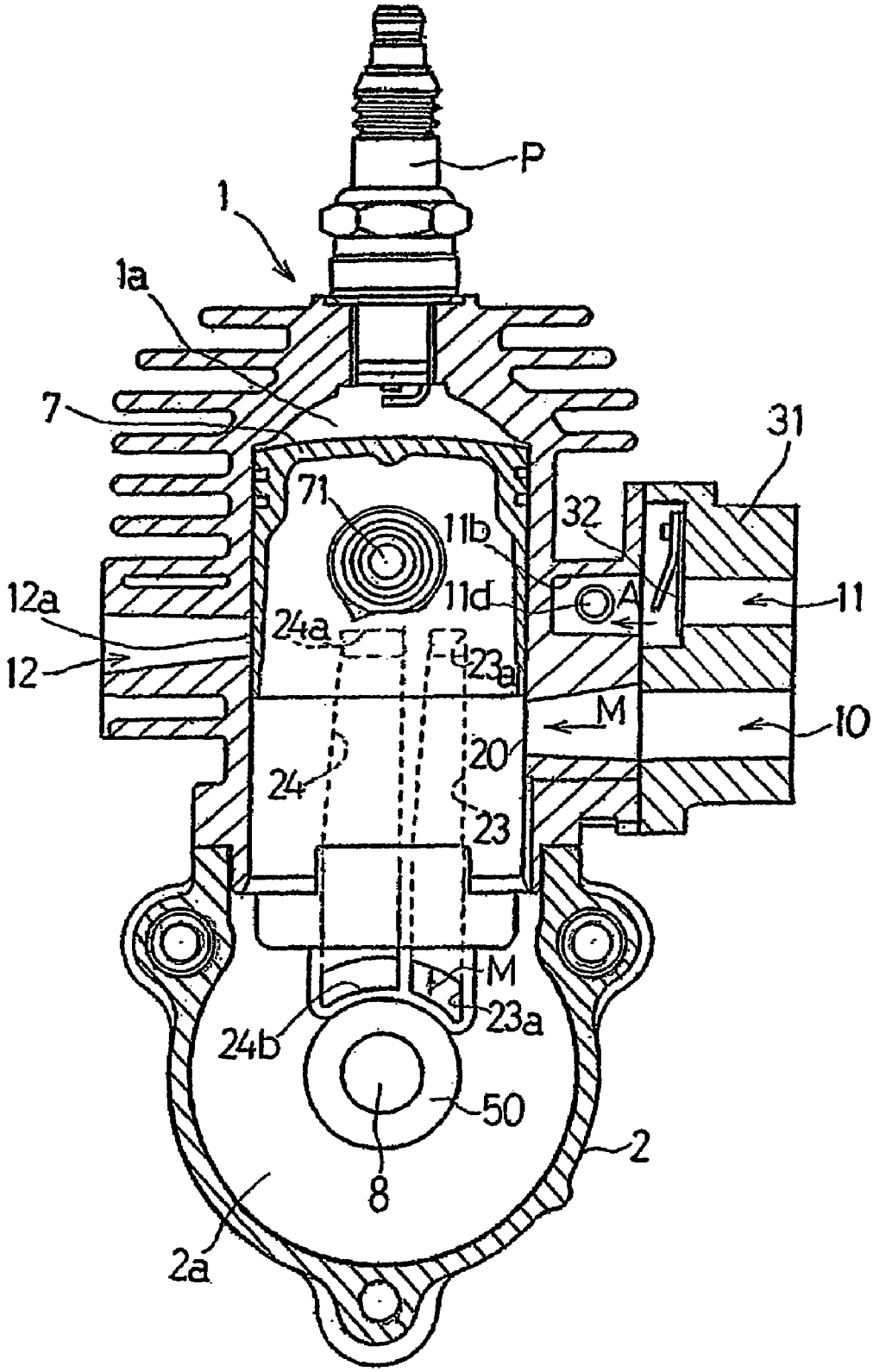
FIG. 29 is a front sectional view of the two-cycle combustion engine according to a seventh preferred embodiment of the present invention, showing the cylinder block and the crankcase employed therein.
Figure 30:
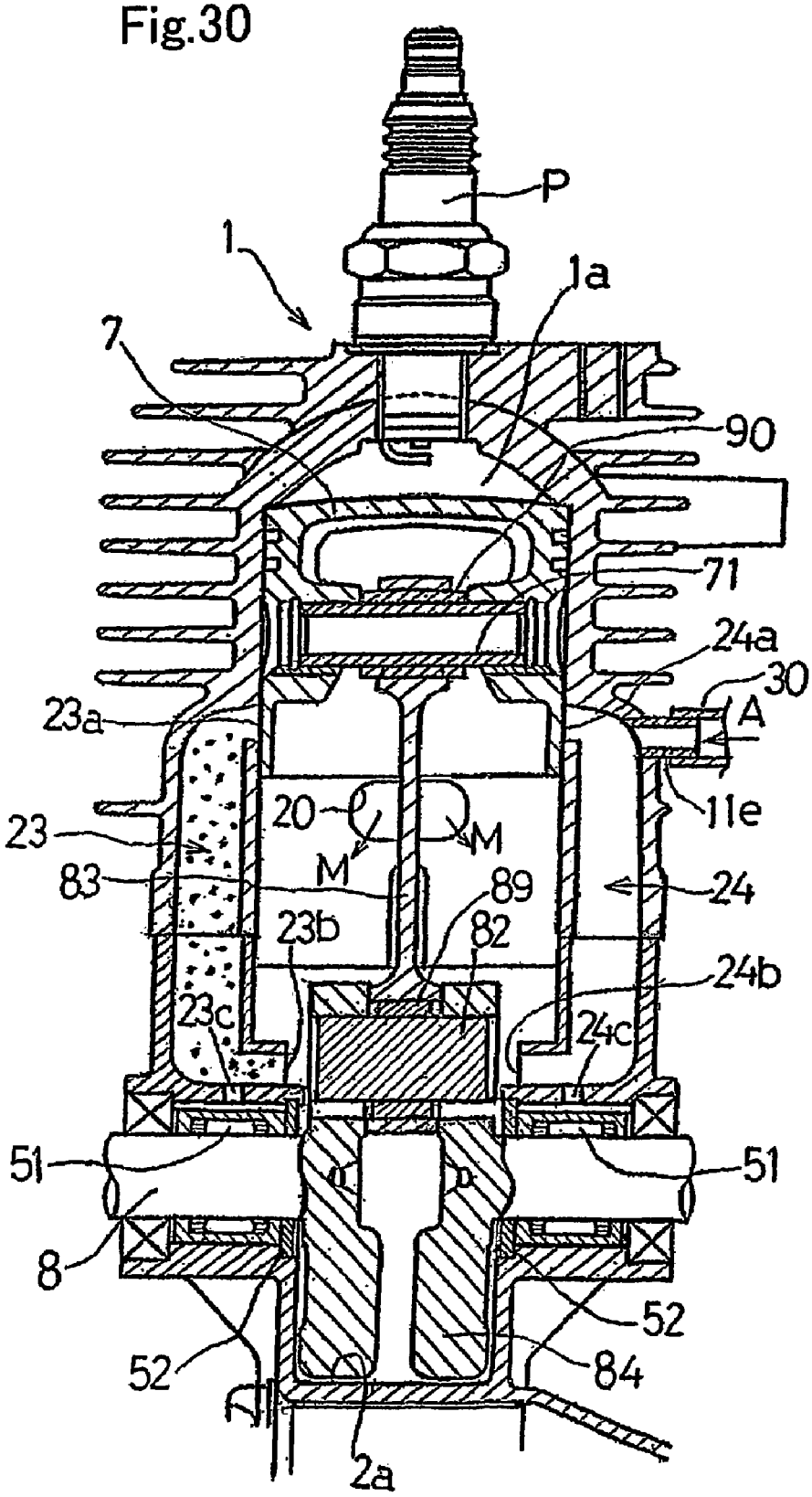
FIG. 30 is a side sectional view of the two-cycle combustion engine of FIG. 29, showing the cylinder block and the crankcase employed therein.

FIG. 29 is a front sectional view showing the cylinder block and the crankcase, and FIG. 30 is a side sectional view showing the cylinder block and the crankcase. While in any one of the first to sixth embodiments a ball bearing has been employed for each of the bearings 81 for supporting the crankshaft 8, in this seventh embodiment the crankshaft 8 shown in FIG. 8 is rotatably supported by needle bearings 51 and, in addition, thrust washers 52 are used to bear the thrust load acting on the crankshaft 8. Considering that each of the needle bearings 51 has, as a general property, an outer diameter smaller than that of the ball bearing, the first and second scavenging passages 23 and 24 are extended straight downwardly, as shown in FIG. 29, a distance corresponding to the difference in outer diameter between the needle bearing 51 and the ball bearings.

In other words, while the second scavenging ports 23*a* and 24*a* at the respective upper ends of the first and second scavenging passages 23 and 24, each employed in a pair, are arranged at a location substantially level with those in the third embodiment (FIG. 18), inflow ports (openings) 23*b* and

24*b* at the respective lower ends thereof are located in the vicinity of radially outer sides of the adjacent needle bearings 51, that is, immediately there above, and formed in an arcuate shape following the curvature of an outer periphery of each of the needle bearings 51. Also, the first and second scavenging passages 23 and 24 are, as shown in FIG. 30, formed with small communicating holes 23*c* and 24*c* for introducing an air-fuel mixture from respective locations adjacent the inflow ports 23*b* and 24*b* to the needle bearings 51.

According to the foregoing construction in accordance with the seventh embodiment, when the negative pressure is developed inside the crank chamber 2*a* shown in FIG. 29 during the intake stroke, the reed valve 32 provided in the air passage 11 is opened to allow the air A flowing through the air passage 11 to be introduced from the air inflow ports 24*b* through the cutout 11*b*, the air introducing ports 11*d*, the connecting pipes 30 (FIG. 30), the air discharge ports 11*e* (FIG. 30) and the second scavenging passages 24 into regions adjacent radially outer sides of the needle bearings 51 within the crank chamber 2*a*, that is, into regions adjacent the crankshaft 8. At this time, as is the case with the third embodiment (FIG. 18), during a period in which the reed valve 32 is opened by the effect of the negative pressure inside the crank chamber 2*a* during the intake stroke, the air A is introduced into the second scavenging passages 24 at all times and, since the second scavenging passages 24 extend downwardly so large a distance that they have a large capacity, a sufficient amount of air for the prevention of the blow-off can be secured within the second scavenging passages 24. On the other hand, during the intake stroke, the air-fuel mixture M flows through the air-fuel mixture passage 10 and is then introduced directly into the crank chamber 2*a*, as shown by the arrows, from the air-fuel mixture ports 20 shown in FIG. 30, which open at the inner peripheral surface of the cylinder block 1. The crankpin 82 is thus satisfactorily lubricated by the air-fuel mixture M so introduced.

During the subsequent scavenging stroke, the sufficient amount of the air accommodated within the second scavenging passages 24 is progressively injected into the combustion chamber 1*a* through the second scavenging ports 24*a* and, thereafter, the leaned air-fuel mixture M, present in the vicinity of the radially outer portions of the needle bearings 51, that is, in a center portion of the crank chamber 2*a*, flows from the inflow ports 23*a* into the first scavenging passages 23 and is then injected into the combustion chamber 1*a* through the first scavenging ports 23*a*, and at the end of the scavenging stroke, the enriched air-fuel mixture M, urged to a region adjacent an inner wall of the crank chamber 2*a* by the effect of a centrifugal force developed by the rotation of the crank webs 84, is introduced into the combustion chamber 1*a* in a delayed fashion. Because of these, the blow-off of the air-fuel mixture M can be further effectively suppressed. At this time, a portion of the air-fuel mixture M within the crank chamber 2*a* enters the needle bearings 51 from the inflow ports 23*b* and 24*b* and then through the first and second scavenging passages 23 and 24 and the associated communicating holes 23*c* and 24*c*, thereby lubricating the needle bearings 51.

In this embodiment, since the first and second scavenging passages 23 and 24 can be formed as a straight passage while being extended a distance downwardly, as compared with the case in which passages are curved and are then extended downwardly so as to detour large ball bearings, the flow resistance in the passage and the loss of output can be reduced, the manufacture is easy to carry out and, since the needle bearings 51 are lighter than the ball bearings, the engine body can be manufactured lightweight.

Hereinafter, the two-cycle combustion engine according to an eighth preferred embodiment of the present invention shown in FIGS. 31 and 32 will be described. This two-cycle combustion engine is similar to that according to the seventh embodiment shown in FIG. 30, but is featured in that the crank webs 84 are used as a valve so that the timings of the scavenging with the air and the air-fuel mixture can be controlled by the crank webs 84, and other structural features of the two-cycle combustion engine according to the eighth embodiment are similar to those according to the seventh embodiment.

Figure 31:
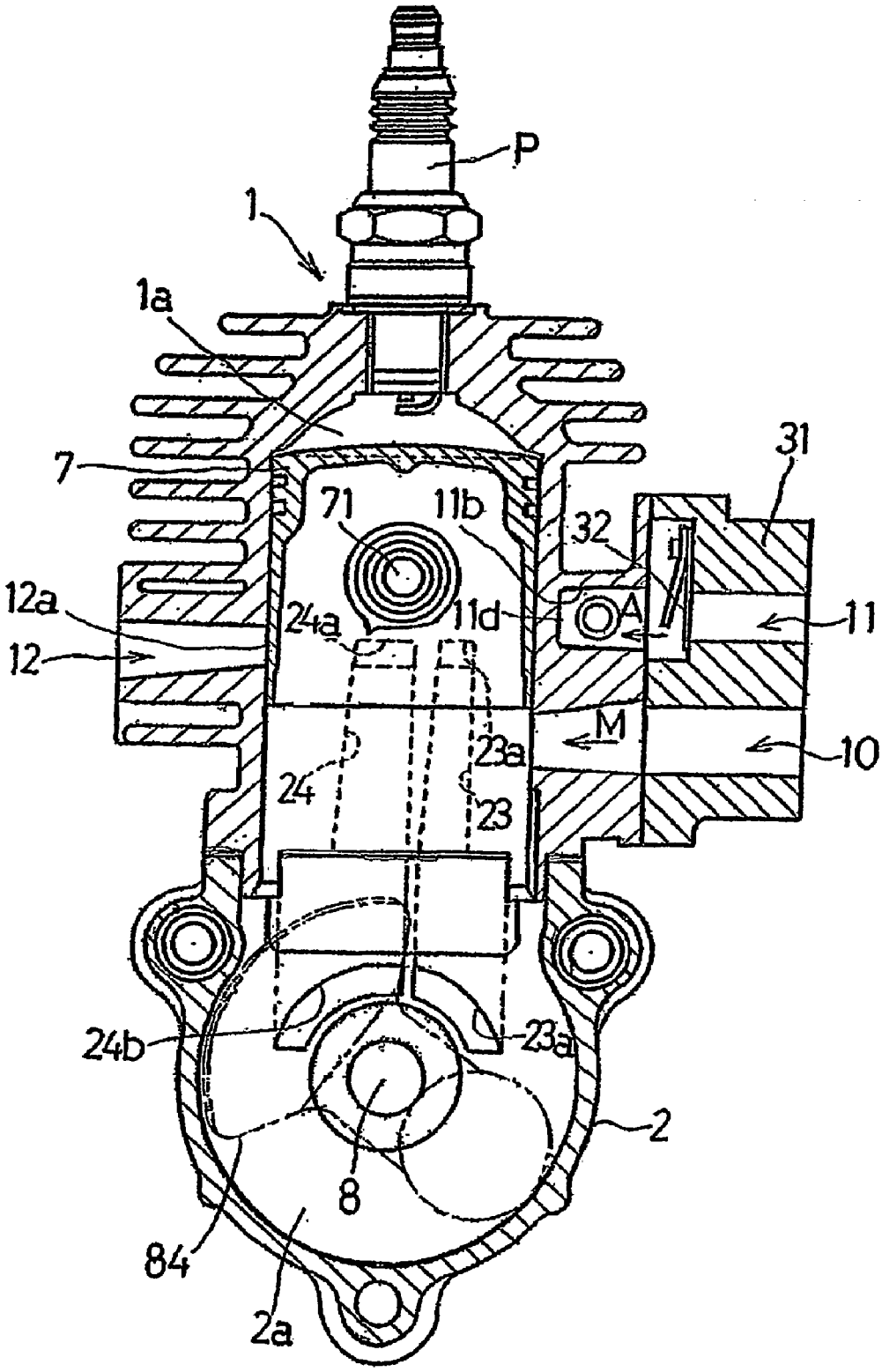
FIG. 31 is a front sectional view of the two-cycle combustion engine according to an eighth preferred embodiment of the present invention, showing the cylinder block and the crankcase employed therein.
Figure 32:
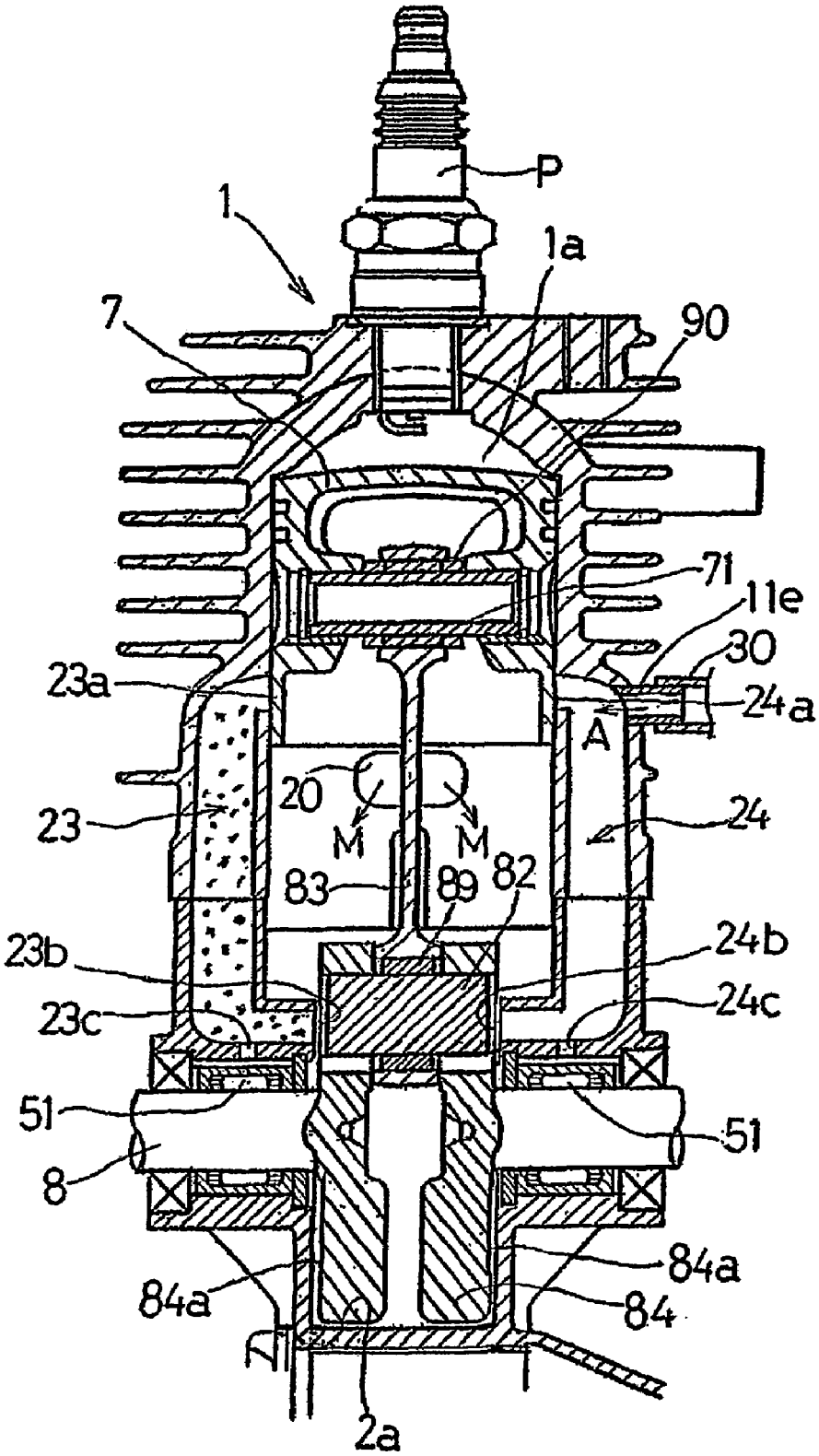
FIG. 32 is a side sectional view of the two-cycle combustion engine of FIG. 31, showing the cylinder block and the crankcase employed therein.

The two-cycle combustion engine according to the eighth embodiment differs from that according to the seventh embodiment in that, as shown in FIG. 32, the respective lower ends of the first and second scavenging passages 23 and 24 are extended centrally of the crank case 2 as compared with those in the seventh embodiment (FIG. 30) with the inflow ports 23*b* and 24*b* positioned as close to respective outer side faces 84*a* of the crank webs 84 as possible and in that those inflow ports 23*b* and 24*b* are so formed as to be of an arcuate shape following the curvature of the outer periphery of the respective needle bearing 51 as shown in FIG. 31 and longer than those in the seventh embodiment (FIG. 29). The inflow port 24*a* for the air A has a shape longer than that of the inflow port 23*a* for the air-fuel mixture M. Accordingly, in this two-cycle combustion engine, the crank webs 84 function as respective valves capable of selectively opening and closing the inflow ports 23*b* and 24*b* as they rotate, and the inflow ports 23*b* and 24*b* are formed to represent an arcuate shape capable of being selectively opened and closed at a predetermined timing according to the rotation of the crank webs 84. Also, the respective upper edges of the second scavenging ports 23*a* and 24*a* of the first and second scavenging passages 23 and 24 are positioned at the same height.

Figure 33:
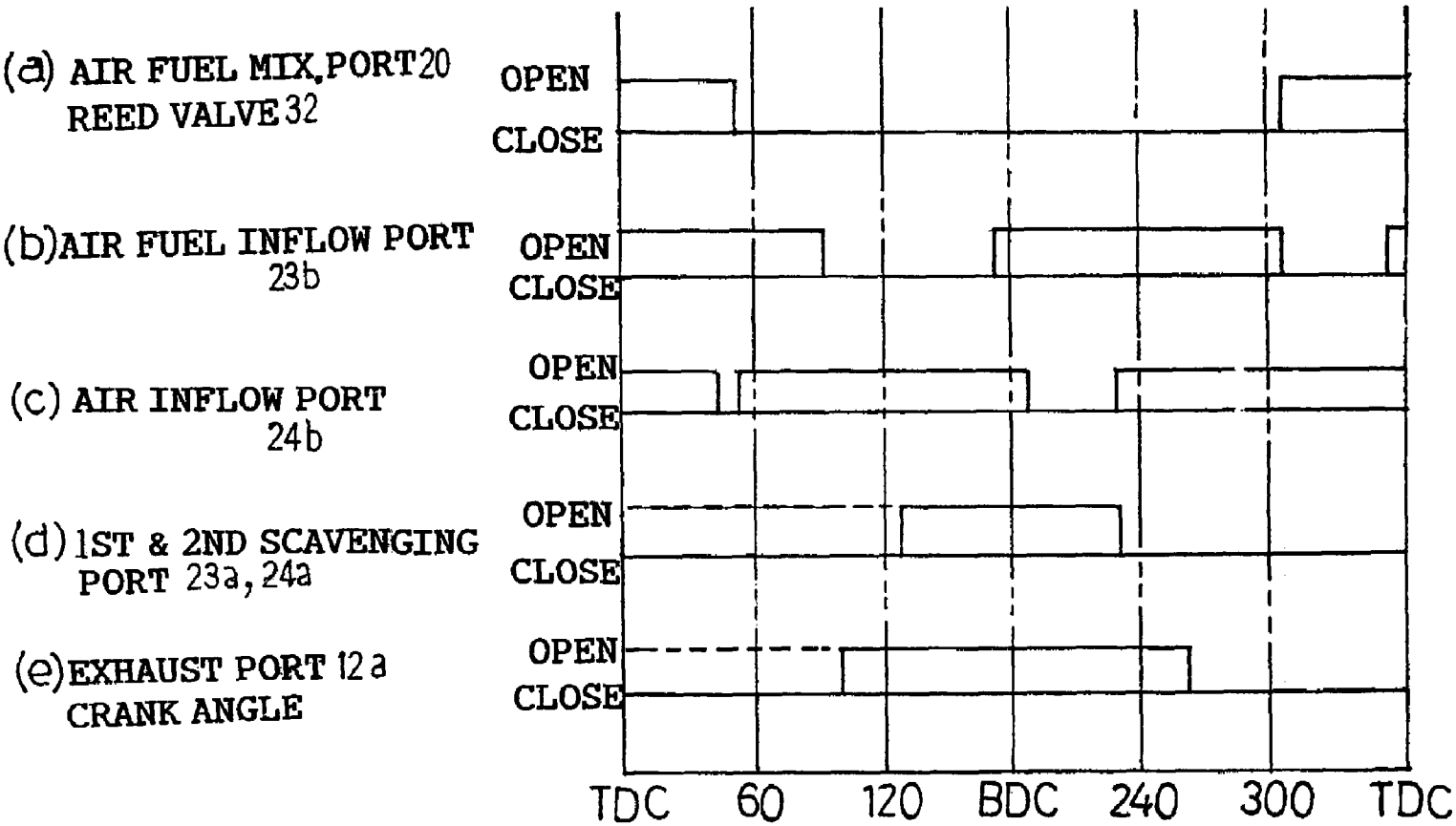
FIG. 33 is a timing chart showing the sequence of operation of the two-cycle combustion engine of FIG. 31.

The operation of the two-cycle combustion engine according to the eighth embodiment will now be described with reference to the timing chart shown in FIG. 33. When during the intake stroke the piston 7 shown in FIG. 31 arrives at the top dead center (TDC) with the cranking angle being 360° (0°), the reed valve 32 is opened as shown in FIGS. 33(*a*) and (*c*), and the inflow ports 24*b* of the second scavenging passages 24 are partially opened by the crank webs 84. Accordingly, as the negative pressure is developed inside the cylinder block 1 and the crank chamber 2*a*, the air A flowing in the air passage 11 can be introduced from the air introducing port 11*d* into a region radially outwardly of the needle bearings 51, that is, from the inflow ports 24*b* in the vicinity of the crankshaft 8 into the crank chamber 2*a*, through the connecting pipes 30, the air discharge ports 11*e* and the second scavenging passages 24. At this time, as is the case with the third embodiment (FIG. 18), during the period in which the reed valve 32 (FIG. 31) is opened in response to the negative pressure inside the crank chamber 2*a* during the intake stroke, the air A is kept introduced into the second scavenging passages 24 at all times and, on the other hand, since the second scavenging passages 24 extend so large a distance to have a large capacity, a sufficient amount of air for the prevention of the blow-off can be secured within the second scavenging passages 24.

On the other hand, during the intake stroke, as shown in FIGS. 33(*a*) and (*c*), since the air-fuel mixture port 20 in FIG. 32 is opened and the inflow ports 23*b* of the first scavenging passages 23 are opened by the crank webs 84, in response to the negative pressure developed inside the crank chamber 2*a* the air-fuel mixture M flowing in the air-fuel mixture 10 shown in FIG. 31 is introduced directly into the crank chamber 2*a*, as shown by the arrows in FIG. 32, through the air-fuel mixture port 20 opening in the inner peripheral surface of the cylinder block 1. The crankpin 82 is satisfactorily lubricated by the air-fuel mixture M so introduced.

During the subsequent scavenging stroke, as shown in FIG. 33(*e*), the exhaust port 12*a* shown in FIG. 31 starts opening at the timing at which the cranking angle attains substantially 100° and, although at this time, as shown in FIG. 33(*c*), the inflow ports 24*a* for the air A of the second scavenging passages 24 are opened, the inflow ports 23*b* for the air-fuel mixture M of the first scavenging passages 23 are closed by the crank webs 84 as shown in FIG. 33(*b*). Further, as shown in FIG. 33(*d*), the first and second scavenging ports 23*a* and 24*a* are both closed until the cranking angle attains substantially about 130°. Accordingly, during a period in which the cranking angle is 100 to 130°, the air A within the second scavenging passages 24 are compressed by the effect of the pressure exerted by the piston 7 then descending and, at the time the second scavenging ports 24*a* are opened, only the air A compressed within the second scavenging passages 24 can be injected at high speed into the combustion chamber 1*a*, with the combustion chamber 1*a* quickly scavenged consequently. Since the sufficient amount of the air A is accumulated within the second scavenging passages 24, the air-fuel mixture M is not entangled in the leading flow of the air A to effectively suppress the blow-off.

Thereafter, when the piston 7 descends to the bottom dead center (BDC), the inflow ports 23*b* for the air-fuel mixture M are opened as shown in FIG. 33(*b*) and, at the time the piston 7 has past the bottom dead center (BDC), the inflow ports 24*b* for the air A are closed as shown in FIG. 33(*c*). Accordingly, within the combustion chamber 1*a* having been substantially completely scavenged, the air-fuel mixture M within the crank chamber 2*a* is injected at high speed from the first scavenging ports 23*a* into the combustion chamber 1*a* through the inflow ports 23*b* by way of the first scavenging passages 23, with the charging efficiency of the air-fuel mixture M into the combustion chamber 1*a* increased consequently.

In this embodiment, since as hereinabove described the inflow ports 23*b* for the air-fuel mixture M, and the inflow ports 24*b* for the air A both opening in the crank chamber 2*a*, are controlled by the crank webs 84 with the latter inflow ports 24*b* opened prior to the former inflow ports 23*b*, the respective upper edges of the first and second scavenging ports 23*a* and 24*a* are set at the same heights to thereby allow them to be opened on the same timing during the descending motion of the piston 7. This scavenging system is more effective than the piston valve system in which the respective positions of the upper ends of the scavenging ports for the air-fuel mixture and the air, respectively, are offset relative to each other. In other words, with the piston valve system, the pressure inside the crankcase at the time the scavenging ports for the air are opened are lower than the pressure inside the crankcase at the time the scavenging ports for the air-fuel mixture and, therefore, it tends to occur that neither a quick scavenging of the combustion chamber with the air nor the suppression of the blow-off can be accomplished effectively.

Now the two-cycle combustion engine according to a ninth preferred embodiment of the present invention will be described with reference to FIGS. 34 and 35. This two-cycle combustion engine is featured in that the crankcase 2 shown in FIG. 34 is of two-piece construction to allow the second scavenging passages 24 to be extended downwardly a further distance than those in the seventh embodiment (FIG. 29), and other structural features of the two-cycle combustion engine according to the ninth embodiment are similar to those according to the seventh embodiment.

Figure 34:
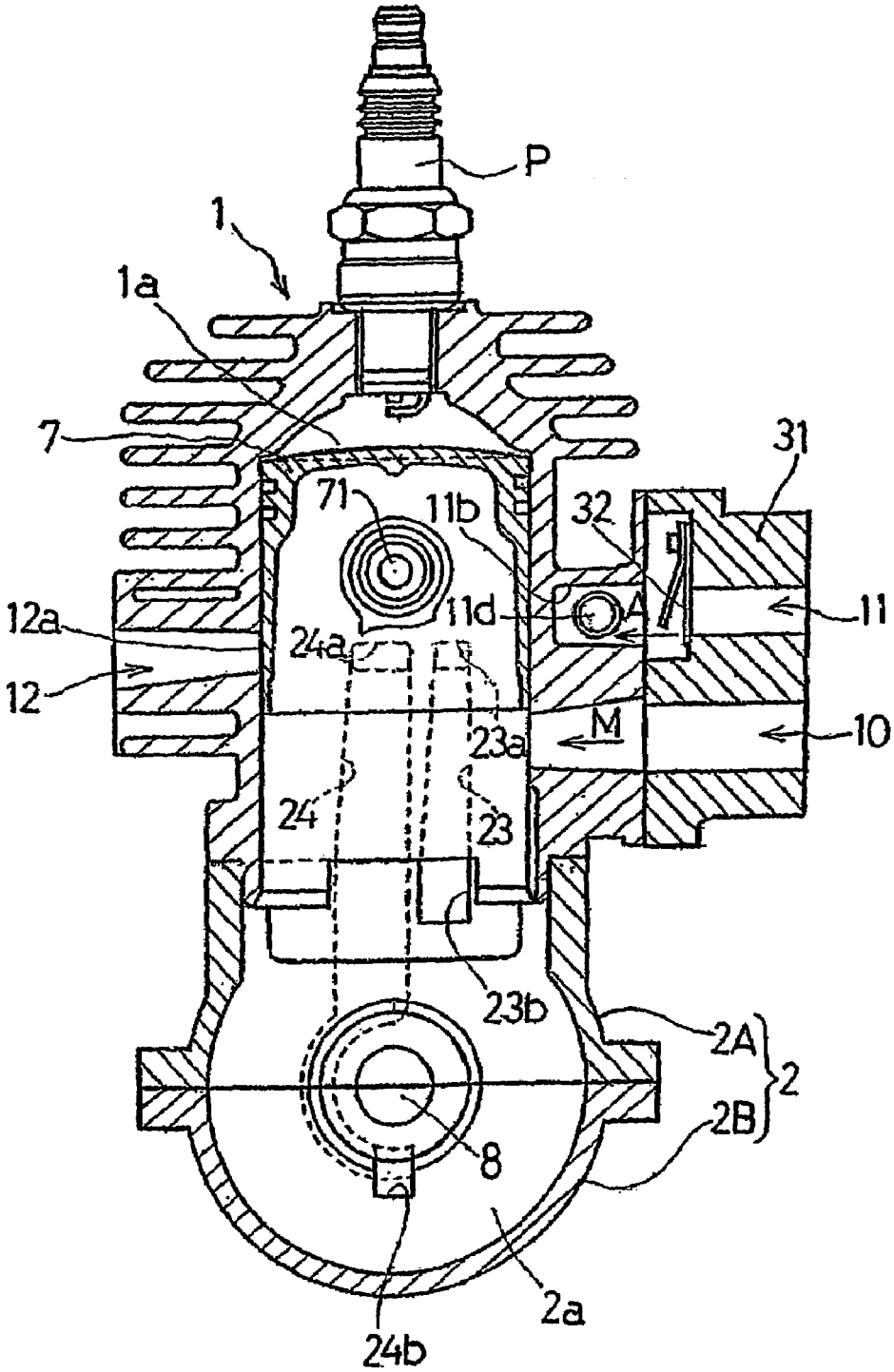
FIG. 34 is a front sectional view of the two-cycle combustion engine according to a ninth preferred embodiment of the present invention, showing the cylinder block and the crankcase employed therein.

As clearly shown in FIG. 34, the crankcase 2 is of the two-piece construction including an upper casing body 2A and a lower casing body 2B connected together, and the second scavenging passages 24 are constructed of respective passage portions that are defined in the upper and lower casing bodies 2A and 2B and communicated with each other. The second scavenging passages 24 have lower end portion formed to extend downwardly around the needle bearings 51 so that the inflow ports 24*b* of the second scavenging passages 24 are opened at respective positions radially below the needle bearings 51. The inflow ports 23*b* at the lower ends of the first scavenging passages 23 are opened at respective positions higher than those in the seventh embodiment (FIG. 29). Other structural features of the two-cycle combustion engine according to the ninth embodiment are similar to those according to the seventh embodiment.

Figure 35:
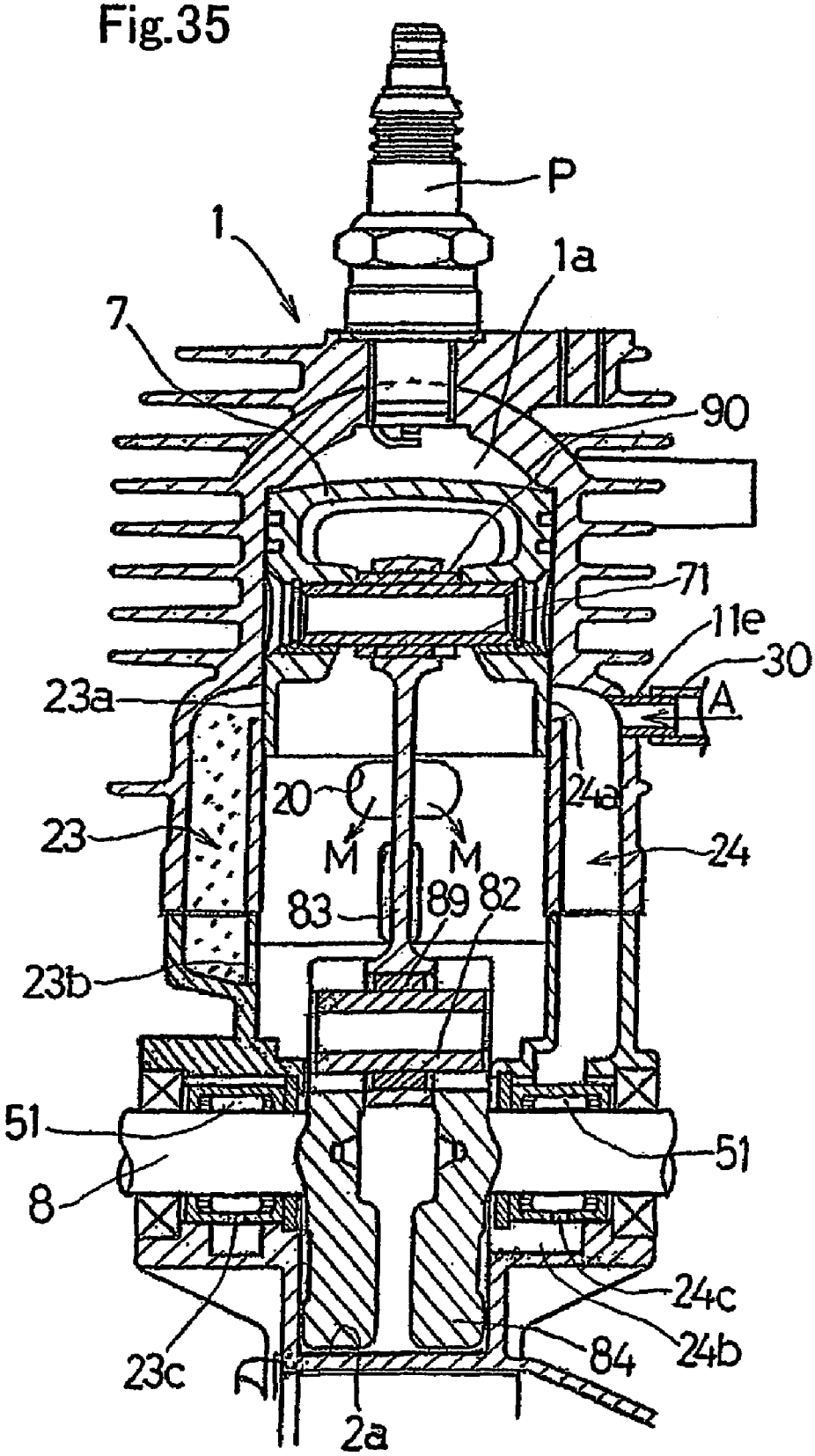
FIG. 35 is a side sectional view of the two-cycle combustion engine of FIG. 34, showing the cylinder block and the crankcase employed therein.

According to the foregoing construction in accordance with the ninth embodiment, since the second scavenging passages shown 24 in FIG. 35 extend down to the position radially of the needle bearings 51, even when the number of revolutions of the engine is increased, a sufficient amount of air required to avoid the blow-off can be secured within the second scavenging passages 24 during the intake stroke. On the other hand, the air-fuel mixture M can be, during the intake stroke, introduced directly into the crank chamber 2*a*, as shown by the arrows, through the air-fuel mixture port 20 open in the inner peripheral surface of the cylinder block 1. The crankpin 82 can be satisfactorily lubricated by the air-fuel mixture so introduced.

During the subsequent scavenging stroke, at the time when the inflow port 24*b* of the second scavenging passage 24 is opened by the crank webs 84, a portion of the air-fuel mixture M in the crank chamber 2*a* enters into the needle bearings 51 through the communication holes 24*c* to thereby lubricate the needle bearings 51.

It is to be noted that although in any one of the seventh to ninth embodiments, the example has been shown which utilizes such basic structure as in the third embodiment, the essential structure of these embodiments, in which the crankshaft 8 is supported by the needle bearings 51 and at least the second scavenging passages 23 and 24 are extended further downwards can be equally applied to the two-cycle combustion engine according to any one of the first, second and fourth to sixth embodiments, but the structure in which the first or second scavenging passages are communicated with the crank chamber through the bearings is eliminated therefrom. Where the foregoing essential structure is applied to the first embodiment, the air-fuel mixture is, during the intake stroke, introduced into the first scavenging passages, not into the crank chamber, and the air is introduced into the crank chamber. In addition, although not encompassed within the present invention, the foregoing important structure can be applied to any standard two-cycle combustion engine of a type in which the scavenging is performed with only the air-fuel mixture introduced into the combustion chamber, other than the type in which the scavenging with the air A is initially performed prior to the scavenging with the air-fuel mixture M. Where the foregoing important structure is applied to this standard two-cycle combustion engine, it is possible to introduce the lean air-fuel mixture, urged to a region adjacent an inner wall of the crank chamber, into the combustion chamber after the lean air-fuel mixture within a center portion of the crank chamber has first been injected into the combustion chamber prior and, therefore, the blow-off of the air-fuel mixture can be suppressed.

What is claimed is:

1. A two-cycle combustion engine which comprises:

a combustion chamber;

a crank chamber accommodating a crankshaft;

a bearing provided on a side wall of the crank chamber for rotatably supporting the crankshaft;

a first scavenging passage for supplying an air-fuel mixture to the combustion chamber; and a second scavenging passage for supplying a scavenge air to the combustion chamber;

wherein one of the first and second scavenging passages communicates between the combustion chamber and the crank chamber through the bearing for the crankshaft, and the other of the first and second scavenging passages communicates directly between the combustion chamber and the crank chamber.

2. The two-cycle combustion engine as claimed in claim 1, wherein the first scavenging passage communicates between the combustion chamber and the crank chamber through the bearing for the crankshaft while the second scavenging passage communicates directly between the combustion chamber and the crank chamber, and further comprising:

a suction chamber formed in a side face of a piston;

an air-fuel mixture passage for introducing an air-fuel mixture M into the suction chamber; and an air passage for introducing an air into the crank chamber;

wherein during an intake stroke of the engine, the air-fuel mixture from the air-fuel mixture passage is introduced into the first scavenging passage through the suction chamber and the air from the air passage is introduced into the crank chamber; and wherein during a scavenging stroke of the engine, introduction of the air within the crank chamber into the combustion chamber through the second scavenging passage takes place before the air-fuel mixture within the first scavenging passage is introduced into the combustion chamber.

3. The two-cycle combustion engine as claimed in claim 2, wherein the piston has a lubricant passage formed therein for supplying the air-fuel mixture within the suction chamber to a small end bearing disposed between a piston pin and a connecting rod.

4. The two-cycle combustion engine as claimed in claim 2, wherein the second scavenging passage is positioned at a location closer to an exhaust port opening to the combustion chamber for discharging an exhaust gas from the combustion chamber than the first scavenging passage in a direction circumferentially of the combustion chamber.

5. The two-cycle combustion engine as claimed in claim 4, Further comprising a third scavenging passage for communicating directly between the combustion chamber and the crank chamber;

the third scavenging passage being positioned at a location closer to the exhaust port than the second scavenging passage in the direction circumferentially of the combustion chamber; and wherein during the scavenging stroke, introduction of the air within the crank chamber into the combustion chamber through the second scavenging passage takes place before an air-fuel mixture introducing timing, at which the air-fuel mixture within the first scavenging passage is introduced into the combustion chamber, and, simultaneously with the air-fuel mixture introducing timing or at a timing thereafter, introduction of the air within the crank chamber through the third scavenging passage takes place.

6. The two-cycle combustion engine as claimed in claim 5, wherein an opening of the second scavenging passage towards the crank chamber is closed by the piston before the piston reaches a bottom dead center.

7. The two-cycle combustion engine as claimed in claim 1, wherein the first scavenging passage communicates directly between the combustion chamber and the crank chamber while the second scavenging passage communicates between the combustion chamber and the crank chamber through the bearing for the crankshaft, and further comprising:

a suction chamber formed in a side face of a piston;

an air passage for introducing an air into the suction chamber; and an air-fuel mixture passage for introducing an air-fuel mixture into the crank chamber;

wherein during an intake stroke of the engine, the air from the air passage is introduced into the second scavenging passage through the suction chamber and the air-fuel mixture from the air-fuel mixture passage is introduced into the crank chamber; and wherein during a scavenging stroke of the engine, introduction of the air within the second scavenging passage into the combustion chamber takes place before the air-fuel mixture within the crank chamber is introduced into the combustion chamber through the first scavenging passage.

8. The two-cycle combustion engine as claimed in claim 7, further comprising an air regulating valve for closing the air passage when a pressure inside the air passage decreases to a value equal to or lower than a predetermined value.

9. The two-cycle combustion engine as claimed in claim 7, wherein an opening of the first scavenging passage towards the crank chamber is closed by the piston before the piston reaches a bottom dead center.

10. The two-cycle as claimed in claim 7, wherein the second scavenging passage is positioned at a location closer to an exhaust port opening to the combustion chamber for discharging an exhaust gas from the combustion chamber than the first scavenging passage in a direction circumferentially of the combustion chamber.

11. The two-cycle combustion engine as claimed in claim 1, wherein the first scavenging passage communicates directly between the combustion chamber and the crank chamber while the second scavenging passage communicates between the combustion chamber and the crank chamber through the bearing for the crankshaft, and further comprising:

an air passage for introducing an air into the second scavenging passage;

a reed valve disposed in the air passage; and an air-fuel mixture passage for introducing an air-fuel mixture into the crank chamber;

wherein during an intake stroke of the engine, the air from the air passage is introduced into the second scavenging passage through the reed valve and the air-fuel mixture from the air-fuel mixture passage is introduced into the crank chamber; and wherein during a scavenging stroke of the engine, introduction of the air within the second scavenging passage into the combustion chamber takes place before the air-fuel mixture within the crank chamber is introduced into the combustion chamber through the first scavenging passage.

12. The two-cycle engine as claimed in claim 11, wherein an opening of the first scavenging passage towards the crank chamber is closed by the piston before the piston reaches a bottom dead center.

13. The two-cycle engine as claimed in claim 11, wherein the second scavenging passage is positioned at a location closer to an exhaust port opening to the combustion chamber for discharging an exhaust gas from the combustion chamber than the first scavenging passage in a direction circumferentially of the combustion chamber.

14. The two-cycle combustion engine as claimed in claim 1, wherein the first scavenging passage communicates directly between the combustion chamber and the crank chamber while the second scavenging passage communicates between the combustion chamber and the crank chamber through the bearing for the crankshaft, and further comprising:

an air-fuel mixture passage for introducing an air-fuel mixture into the first scavenging passage;

an air passage for introducing an air into the second scavenging passage;

a first reed valve disposed in the air-fuel mixture passage;

a second reed valve disposed in the air passage;

wherein during an intake stroke of the engine, the air-fuel mixture from the air-fuel mixture passage is introduced into the first scavenging passage and the air from the air passage is introduced into the second scavenging passage; and wherein during a scavenging stroke of the engine, introduction of the air within the second scavenging passage into the combustion chamber takes place before the air-fuel mixture within the first scavenging passage is introduced into the combustion chamber.

15. The two-cycle engine as claimed in claim 14, wherein the second scavenging passage is positioned at a location closer to an exhaust port opening to the combustion chamber for discharging an exhaust gas from the combustion chamber than the first scavenging passage in a direction circumferentially of the combustion chamber.

16. A two-cycle combustion engine, which comprises:

a needle bearing for supporting a crankshaft within a crankcase;

first and second scavenging passages for communicating between a combustion chamber and a crank chamber;

an air-fuel mixture passage for introducing an air-fuel mixture into the crank chamber or the first scavenging passage during an intake stroke;

an air passage for introducing an air into the second scavenging passage or the crank chamber during the intake stroke; and a communicating hole for fluidly connecting the first or second scavenging passage with the needle bearing;

wherein during a scavenging stroke of the engine, introduction of the air within the second scavenging passage into the combustion chamber takes place prior to the air-fuel mixture within the first scavenging passage being introduced into the combustion chamber; and wherein an opening of a lower end of the second scavenging passage towards the crank chamber is positioned at a location adjacent a region radially outwardly of the needle bearing.

17. The two-cycle combustion engine as claimed in claim 16, wherein an opening of a lower end of the first scavenging passage towards the crank chamber is positioned at a location adjacent a region radially outwardly of the needle bearing.

* * * * *

UNITED STATES PATENT AND TRADEMARK OFFICE

CERTIFICATE OF CORRECTION

PATENT NO. : 7,536,982 B2
APPLICATION NO. : 10/530153
DATED : May 26, 2009
INVENTOR(S) : Tsuneyoshi Yuasa et al.

It is certified that error appears in the above-identified patent and that said Letters Patent is hereby corrected as shown below:

On the Front Page

(22) PCT Filed: "Oct. 10, 2003" should read --Oct. 2, 2003--

Signed and Sealed this
Thirtieth Day of August, 2011

David J. Kappos

David J. Kappos
*Director of the United States Patent and Trademark Office*